US009488004B2

(12) United States Patent
Twardowski et al.

(10) Patent No.: US 9,488,004 B2
(45) Date of Patent: Nov. 8, 2016

(54) SUBSEA CASING DRILLING SYSTEM

(71) Applicant: Weatherford Technology Holdings, LLC, Houston, TX (US)

(72) Inventors: Eric M. Twardowski, Spring, TX (US); Albert C. Odell, II, Kingwood, TX (US); Jose A. Trevino, Houston, TX (US)

(73) Assignee: Weatherford Technology Holding, LLC, Houston, TX (US)

( * ) Notice: Subject to any disclaimer, the term of this patent is extended or adjusted under 35 U.S.C. 154(b) by 675 days.

(21) Appl. No.: 13/774,989

(22) Filed: Feb. 22, 2013

(65) Prior Publication Data

US 2013/0233547 A1 Sep. 12, 2013

Related U.S. Application Data

(60) Provisional application No. 61/601,676, filed on Feb. 22, 2012.

(51) Int. Cl.

| | |
|---|---|
| ***E21B 33/14*** | (2006.01) |
| ***E21B 4/02*** | (2006.01) |
| ***E21B 4/00*** | (2006.01) |
| ***E21B 7/20*** | (2006.01) |
| ***E21B 33/04*** | (2006.01) |

(52) U.S. Cl.

CPC . *E21B 4/02* (2013.01); *E21B 4/00* (2013.01); *E21B 7/208* (2013.01); *E21B 33/0422* (2013.01); *E21B 33/14* (2013.01)

(58) Field of Classification Search

CPC ..... E21B 17/046; E21B 33/14; E21B 4/02; E21B 7/20; E21B 7/203; E21B 7/208

See application file for complete search history.

(56) References Cited

U.S. PATENT DOCUMENTS

| | | | |
|---|---|---|---|
| 4,154,298 | A | 5/1979 | Gano |
| 4,423,889 | A | 1/1984 | Weise |
| 5,148,875 | A | 9/1992 | Karlsson et al. |
| 5,168,942 | A | 12/1992 | Wydrinski |
| 5,551,521 | A | 9/1996 | Vail, III |
| 5,845,722 | A | 12/1998 | Makohl et al. |
| 5,984,029 | A | 11/1999 | Griffin et al. |
| 6,003,607 | A | 12/1999 | Hagen et al. |
| 6,196,336 | B1 | 3/2001 | Fincher et al. |

(Continued)

FOREIGN PATENT DOCUMENTS

| | | |
|---|---|---|
| WO | 02055838 | 7/2002 |
| WO | 2004079151 A2 | 9/2004 |
| WO | 2007091054 | 8/2007 |

OTHER PUBLICATIONS

Dictionary Definition: Piston; http://dictionary.reference.com/browse/piston; Aug. 4, 2015.*

(Continued)

*Primary Examiner* — Shane Bomar
*Assistant Examiner* — Christopher Sebesta
(74) *Attorney, Agent, or Firm* — Patterson & Sheridan, LLP

(57) ABSTRACT

In one embodiment, a casing bit drive assembly may be used with a casing drilling system. The casing bit drive assembly may include one or more of the following: a retrievable drilling motor; a decoupled casing sub; a releasable coupling between the motor and casing bit; a releasable coupling between the motor and casing; a cement diverter; and a casing bit.

25 Claims, 46 Drawing Sheets

(56) References Cited

U.S. PATENT DOCUMENTS

| | | | | |
|---|---|---|---|---|
| 6,223,823 | B1 | 5/2001 | Head | |
| 6,412,574 | B1 | 7/2002 | Wardley et al. | |
| 6,450,541 | B1 | 9/2002 | Bakke | |
| 6,725,919 | B2 | 4/2004 | Cook et al. | |
| 6,857,487 | B2 | 2/2005 | Galloway et al. | |
| 6,899,186 | B2 | 5/2005 | Galloway et al. | |
| 7,044,241 | B2 | 5/2006 | Angman | |
| 7,048,050 | B2 | 5/2006 | Vail, III et al. | |
| 7,093,675 | B2 | 8/2006 | Pia | |
| 7,100,710 | B2 | 9/2006 | Vail, III | |
| 7,108,083 | B2 | 9/2006 | Simonds et al. | |
| 7,174,963 | B2 | 2/2007 | Bertelsen | |
| 7,311,148 | B2 | 12/2007 | Giroux et al. | |
| 7,334,650 | B2 | 2/2008 | Giroux et al. | |
| 7,730,965 | B2 | 6/2010 | Jordan et al. | |
| 7,938,201 | B2 | 5/2011 | Giroux et al. | |
| 2003/0024708 | A1 | 2/2003 | Ring et al. | |
| 2003/0056991 | A1 | 3/2003 | Hahn et al. | |
| 2003/0141111 | A1 | 7/2003 | Pia | |
| 2003/0192704 | A1 | 10/2003 | Ford et al. | |
| 2004/0011534 | A1 | 1/2004 | Simonds et al. | |
| 2004/0069501 | A1* | 4/2004 | Haugen et al. | 166/381 |
| 2004/0216925 | A1 | 11/2004 | Metcalfe et al. | |
| 2004/0221997 | A1 | 11/2004 | Giroux et al. | |
| 2004/0245020 | A1* | 12/2004 | Giroux et al. | 175/61 |
| 2004/0251051 | A1* | 12/2004 | Downie et al. | 175/57 |
| 2005/0152749 | A1 | 7/2005 | Anres et al. | |
| 2005/0199426 | A1* | 9/2005 | Smith et al. | 175/57 |
| 2006/0196695 | A1* | 9/2006 | Giroux et al. | 175/57 |
| 2010/0126776 | A1 | 5/2010 | Trevino et al. | |
| 2011/0315380 | A1* | 12/2011 | Sherman | 166/285 |

OTHER PUBLICATIONS

PCT Search Report and Written Opinion for International Application No. PCT/US2013/027490 dated Sep. 17, 2014.

PCT International Search Report and Written Opinion for Application PCT/US2013/027495, dated Jul. 4, 2014.

Canadian Office Action dated Oct. 2, 2015, for Canadian Application No. 2,864,149.

Canadian Office Action dated Aug. 15, 2016, for Canadian Patent Application No. 2,864,149.

* cited by examiner

SUBSEA CASING DRILLING SYSTEM

BACKGROUND OF THE INVENTION

1. Field of the Invention

The present invention generally relates to an apparatus and method for casing drilling. More particularly, the invention relates to a subsea casing drilling system and methods therefor.

2. Description of the Related Art

In the oil and gas producing industry, the process of cementing casing into the wellbore of an oil or gas well generally comprises several steps. For example, a conductor pipe is positioned in the hole or wellbore and may be supported by the formation and/or cemented. Next, a section of a hole or wellbore is drilled with a drill bit which is slightly larger than the outside diameter of the casing which will be run into the well.

Thereafter, a string of casing is run into the wellbore to the required depth where the casing lands in and is supported by a well head in the conductor. Next, cement slurry is pumped into the casing to fill the annulus between the casing and the wellbore. The cement serves to secure the casing in position and prevent migration of fluids between formations through which the casing has passed. Once the cement hardens, a smaller drill bit is used to drill through the cement in the shoe joint and further into the formation.

Although the process of drilling with casing has improved, there is still a need for further improvements in drilling with casing techniques.

SUMMARY OF THE INVENTION

Embodiments of the present invention provide a casing bit drive assembly suitable for use with a casing drilling system. The casing bit drive assembly may include one or more of the following: a retrievable drilling motor; a decoupled casing sub including a drilling member such as a casing bit; a releasable coupling between the motor and drilling member; a releasable coupling between the motor and casing; a cement diverter; and a drilling member.

In one embodiment, a casing drilling system includes a casing; a drilling member coupled to the casing; a retrievable motor releasably coupled to the casing and includes a power section configured to rotate the drilling member relative to the casing; and a cement diverter for diverting cement from the power section of the drilling motor.

In another embodiment, a method of forming a wellbore in a formation includes providing a first casing with a motor for rotating a drilling member relative to the first casing; coupling the first casing to a second casing; lowering the first casing and the second casing into the formation; releasing the first casing from the second casing; rotating the drilling member to extend the wellbore; supplying cement around the motor and into the wellbore; detaching the motor from the drilling member; and retrieving the motor.

In one or more of the embodiments described herein, the motor includes a rotating portion and non-rotating housing, wherein the power section comprises an annular area between the rotating portion and a non-rotating portion.

In one or more of the embodiments described herein, the system may include a coupling for transferring load between the non-rotating housing and the casing.

In one or more of the embodiments described herein, the system may further include a bearing for transmitting load from an output connected to the rotating portion to the non-rotating housing.

In one or more of the embodiments described herein, the motor includes an arcuate recess formed in non-rotating housing, wherein a ball received at an end of the arcuate recess prevents relative rotation between the rotating portion and the non-rotating housing.

In one or more of the embodiments described herein, the cement diverter includes a diverter sub coupled to the motor; a cementing tube in selectively fluid communication with a bore of the diverter sub; and a sleeve disposed in the bore, wherein the sleeve is selectively actuatable to open fluid communication to the cementing tube.

In one or more of the embodiments described herein, the cement diverter includes a diverter sub coupled to the motor and including a bore extending therethrough; a sleeve releasably coupled to the bore; and a diverter piston releasably coupled to the sleeve, wherein the sleeve is configured to release at a lower force than the diverter piston.

In one or more of the embodiments described herein, the system includes a locking mechanism to prevent relative rotation between drilling member and the casing.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 15-18 are enlarged views of the motor.

DETAILED DESCRIPTION

Figure 1A:
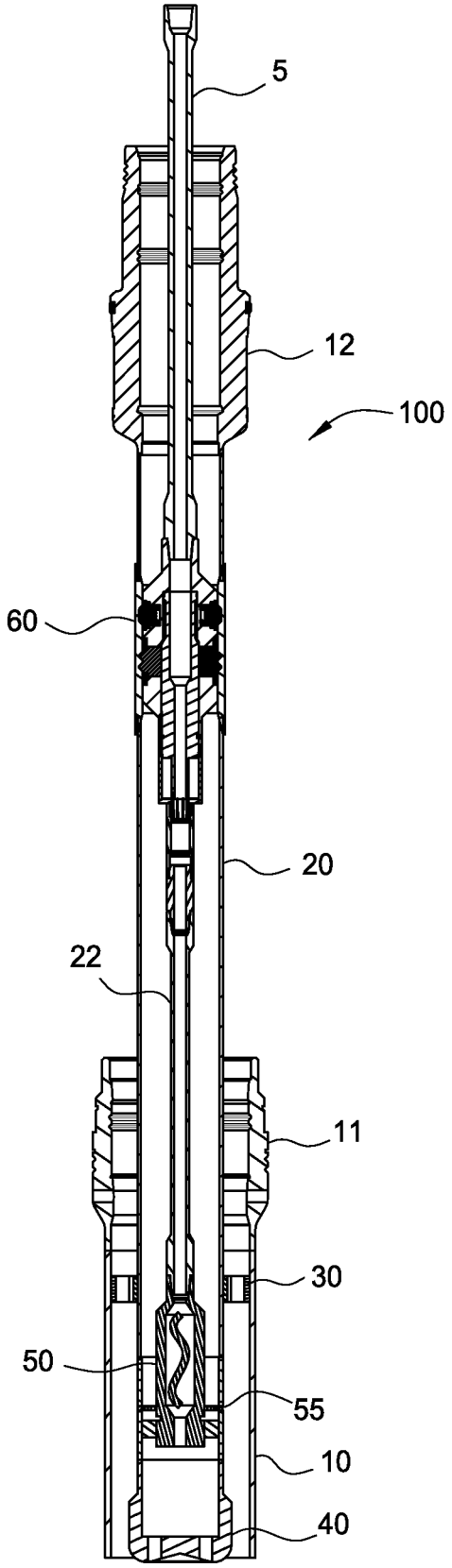
FIGS. 1A and 1B show an exemplary embodiment of a casing drilling system.

Embodiments of the present invention generally relates to a casing drilling system. In one embodiment, the system includes a conductor casing coupled to a surface casing and the coupled casings can be run concurrently. In one trip, the system will jet-in the conductor casing and a low pressure wellhead housing, unlatch the surface casing from the conductor casing, drill the surface casing to target depth, land a high pressure wellhead housing, cement, and release. The system includes a drill bit that may be powered by a retrievable downhole motor which rotates the drill bit independently of the surface casing string. In another embodiment, the system may also include the option of rotating the drilling bit from surface.

Exemplary drilling motors include positive displacement motors (PDM) and downhole turbo-drills. The drilling motor is used to rotate the casing bit. A releasable coupling is used to couple the rotating output shaft of the drilling motor to the casing bit. When this coupling is engaged, axial and torsion loads may be transmitted between the motor output shaft and the casing bit.

A second releasable coupling is used to transfer axial and torsional loads from the non-rotating motor housing to the surface casing. The second coupling allows reactive forces to be transmitted between the motor housing and the casing. The second coupling may be positioned above the first coupling and thus may be referred to as the upper coupling.

The motor may include bearings to transmit loads from the rotating motor output shaft to the non-rotating motor housing. These bearings are configured to carry the drilling loads. Exemplary bearings include a sealed bearing pack and a mud lubricated bearing pack.

The couplings and the bearings may provide a load path from the casing bit, to the lower coupling, to the motor output shaft, through the motor bearings, to the motor housing, to the upper coupling, and to the surface casing.

The motor may also include features for cementing either around or through the drilling motor. In one embodiment, a cement diverter mechanism is used to alter the flow path for cementing purposes. Separate flow paths are available for drilling fluid flow during drilling mode and cement flow during cementing mode. This mechanism limits the chances of inadvertently cementing the motor in place. In another embodiment, the power section of the drilling motor is sealed off prior to pumping cement, in order to prevent damage to the power section from hardened cement.

In one embodiment, tandem drilling float valves are installed in the bore of the drilling motor's output shaft. These float valves provide a pressure barrier to prevent u-tubing of drilling fluid or cement, when the pumps are not circulating fluid down the drillstring.

The motor may optionally include a contingency lock-out feature to prevent the motor from rotating in the event of motor damage. If the power section experiences wear during drilling, this feature would allow for continued drilling by rotating the entire casing string and casing bit from surface.

The casing sub allows the casing bit to be rotated independently, or relative to, the surface casing. The casing sub may be decoupled from the casing bit. In one embodiment, the motor bearings are used to carry the drilling loads. In another embodiment, the bearings could also be positioned in the de-coupled casing sub.

If the motor bearings are used, the decoupled casing sub provides an interface between the non-rotating surface casing and the rotating casing bit. The upper portion of the decoupled casing sub is connected directly to the lower end of the surface casing. The lower end of the decoupled casing sub is adjacent to the upper end of the casing bit. The interface may optionally contain a rotating "material seal" that helps prevent formation cuttings from entering the casing bit. In one embodiment, the rotating material seal does not provide a pressure-tight seal.

The decoupled casing sub may also provide a locking mechanism that prevents rotation of the casing bit during subsequent drill-out operations. In ideal conditions, a good cement job at the casing shoe will prevent the casing bit from spinning freely as it is drilled-out. If the casing bit is not rotationally constrained, drill-out would be problematic. In the event of a poor quality cement job, or "wet shoe", a mechanical locking mechanism provides a contingency mechanism for rotationally locking the casing bit and decoupled casing sub to the non-rotating surface casing. This allows the casing bit to be drilled-out more easily.

In one embodiment, an optional secondary flapper float valve may be held in the open position by the motor housing. The motor is positioned such that it passes through the bore of the float valve, thus preventing the spring loaded flapper from pivoting into the closed position. This secondary flapper remains in the open position during the drilling and cementing processes. After drilling and cementing operations are completed, the motor is retrieved up through the secondary flapper float valve. Once the motor is no longer effectively holding the float valve in the open position, the spring loaded flapper is free to pivot into the closed position. This secondary flapper float valve remains in place after the motor is retrieved, and acts as a secondary pressure barrier. This barrier feature may act as a safety feature, especially in the event of a poor quality cement job at the shoe.

The releasable couplings and the secondary flapper float valve remain in the drill-out path after the motor is retrieved may be manufactured from a drillable material. Aluminum is a suitable material, but other drillable materials with sufficient strength may also be used (i.e. composite, polymer, copper, brass, bronze, zinc, tin, or alloys thereof). The nose and cutting structure of the casing bit are also designed to be readily drillable. This allows the next drill-out BHA to easily drill though the remaining components in the shoe track, before proceeding to drill new formation.

An exemplary casing drilling method is disclosed in U.S. patent application Ser. No. 12/620,581, which application is incorporated herein in its entirety.

Embodiments of the present invention include a casing bit drive assembly suitable for use in a casing drilling system and method. The casing bit drive assembly includes one or more of the following: a retrievable drilling motor; a decoupled casing sub; a releasable coupling between the motor and casing bit; a releasable coupling between the motor and casing; a cement diverter; and a casing bit.

Figure 1B:
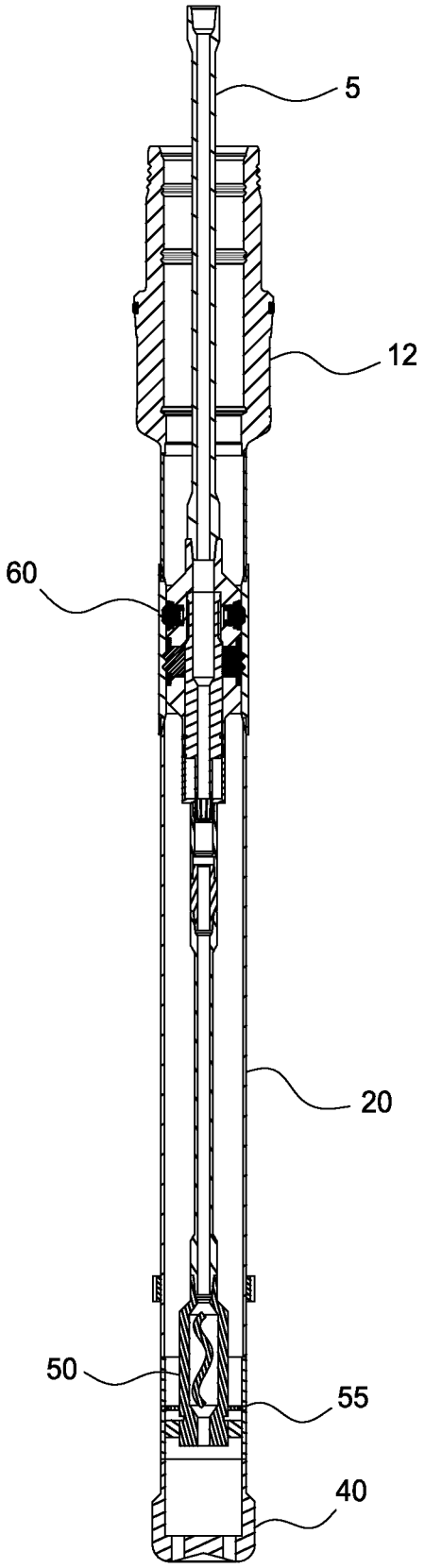

FIGS. 1A and 1B show an exemplary embodiment of a casing drilling system 100. The casing drilling system 100 includes a conductor casing 10 coupled to a surface casing 20 and the coupled casings 10, 20 may be run concurrently. The casings 10, 20 may be coupled using a releasable latch 30. A high pressure wellhead 12 connected to the surface casing 20 is configured to land in the low pressure wellhead 11 of the conductor casing 10. The drill string 5 and the inner string 22 are coupled to the surface casing 20 using a running tool 60. A motor 50 is provided at the lower end of the inner string 22 to rotate the casing bit 40. In another embodiment, the casing bit 40 may be rotated using torque transmitted from the surface casing 20. An optional swivel 55 may be included to allow relative rotation between the casing bit 40 and the surface casing 20. In operation, the casing drilling system 100 is run-in on the drillstring 5 until it reaches the sea floor. The system 100 is then "jetted" into the soft sea floor until the majority of the length of the conductor casing 10 is below the mudline, with the low pressure wellhead housing 11 protruding a few feet above the mudline. The system 100 is then held in place for a time, such as a few hours, to allow the formation to "soak" or re-settle around the conductor casing 10. After "soaking", skin friction between the formation and the conductor casing 10 will support the weight of the conductor casing 10.

The releasable latch 30 is then deactivated to decouple the surface casing 20 from the conductor casing 10. In one embodiment, the surface casing 20 has a 22 inch diameter and the conductor casing 10 has a 36 inch diameter. After unlatching from the conductor casing 10, the surface casing 20 is drilled or urged ahead. The casing bit 40 is rotated by the downhole drilling motor 50 to extend the wellbore. The decoupled drilling swivel 55 allows the casing bit 40 to rotate independently of the casing string 20 (although the casing string may also be rotated from surface). Upon reaching target depth ("TD"), the high pressure wellhead 12 is landed in the low pressure wellhead housing 11. Since the casing string 20 and high pressure wellhead 11 do not necessarily need to rotate, drilling may continue as the high pressure wellhead 12 is landed, without risking damage to the wellhead's sealing surfaces.

After landing the wellhead 12, it is likely that the formation alone will not be able to support the weight of the surface casing 20. If the running tool 60 was released at this point, it is possible that the entire casing string 20 and wellhead 112 could sink or subside below the mudline. For this reason, the running tool 60 must remain engaged with the surface casing 20 and weight must be held at surface while cementing operations are performed. After cementing, the running tool 60 continues holding weight from surface until the cement has cured sufficiently to support the weight of the surface casing 20.

After the cement has cured sufficiently, the running tool 60 is released from the surface casing 20. The running tool 60, inner string 22, and drilling motor 50 are then retrieved to surface.

A second bottom hole assembly ("BHA") is then run in the hole to drill out the cement shoe track and the drillable casing bit 40. This drilling BHA may continue drilling ahead into new formation.

The embodiments described below illustrate several concepts for the bit drive assembly. Some of the features are common to multiple concepts. It is contemplated that features described in one concept is not limited for use with that concept, but may be used with another concept.

Figure 2:
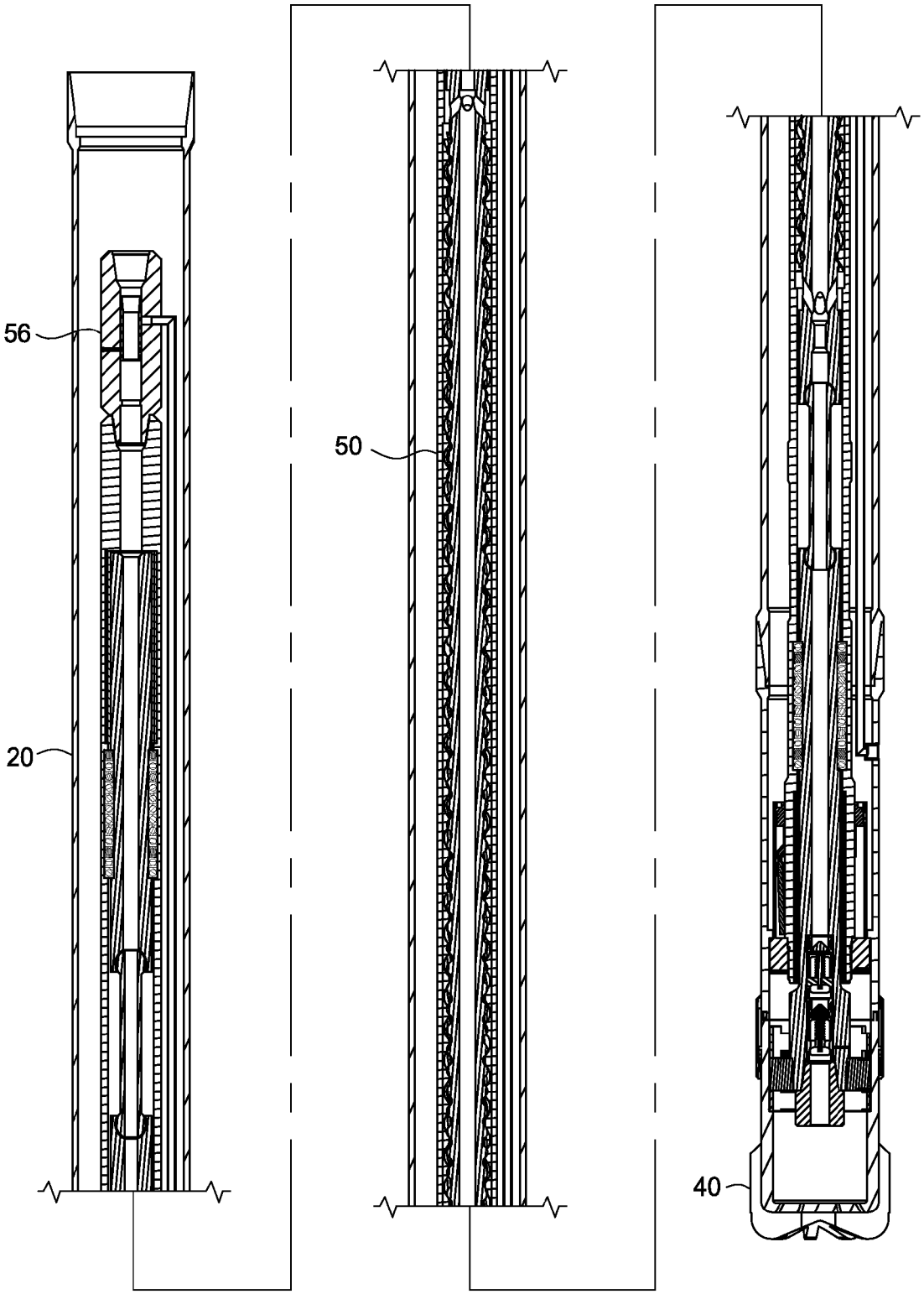
FIG. 2 illustrates an embodiment of a casing drilling system without the conductor casing.

FIG. 2 illustrates an embodiment of a casing drilling system 100 without the conductor casing 10. FIGS. 3-7 are enlarged partial views of FIG. 1. The surface casing 20 (e.g., 22 inch casing) includes an inner string 22 disposed therein. Connected below the inner string 22 are a diverter sub 56, a drilling motor 50, and a motor output shaft 62. The motor output shaft 62 is configured to rotate a casing bit 40 relative to the surface casing 20.

In one embodiment, a drilling motor 50 includes features to flow cement around the motor 50, as opposed to through the motor 50. This limits the possibility of inadvertently cementing the motor 50 in place. Since no cement is pumped through the motor 50, it is unlikely that the expensive motor 50 components will be damaged as a result of hardened cement remaining inside the motor 50. The bypass around the motor 50 may cause the cement to enter the annulus at a short distance such as a few feet above the casing bit 40.

Figure 3:
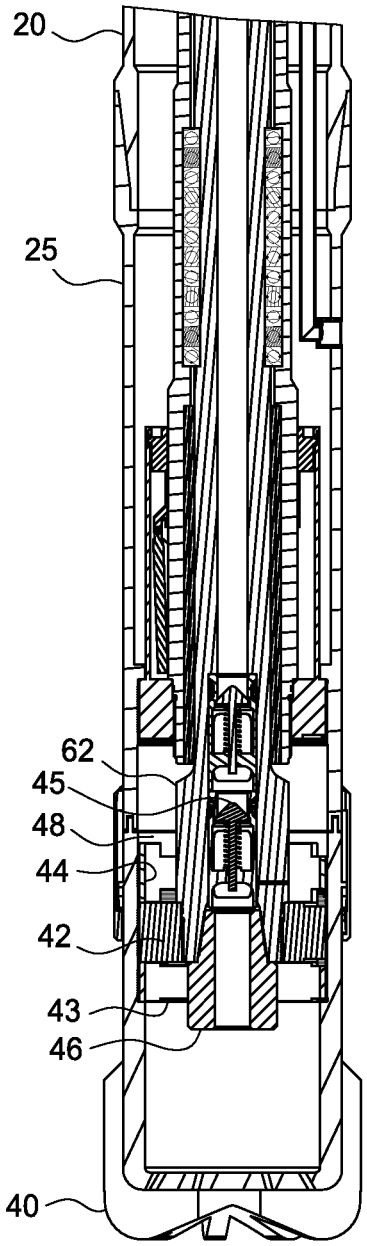
FIGS. 3-7 are enlarged partial views of FIG. 1.
Figure 4:
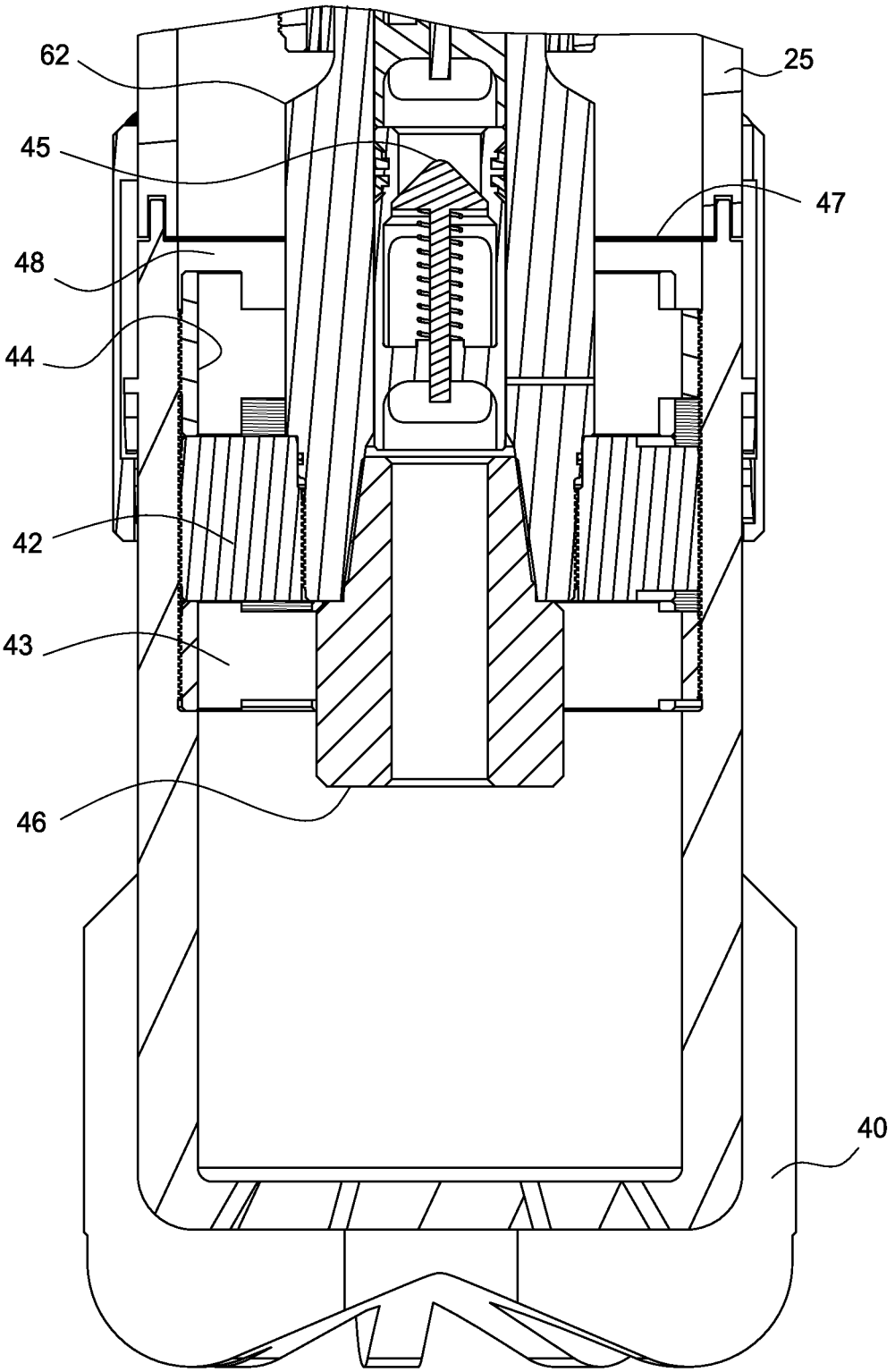

Referring to FIGS. 3 and 4, the lower end of the bit drive assembly contains a drillable casing bit 40. An exemplary casing bit 40 suitable for use with this and other concepts described herein or illustrated in the Figures is Weatherford's Defyer DPA casing bit. The casing bit 40 is coupled to the motor output shaft 62 by a threaded aluminum (or other drillable material) coupling 42. Threads on the outer diameter ("OD") of the coupling 42 are secured to the casing bit 40. The threads on the inner diameter ("ID") of the coupling 42 are secured to the motor output shaft 62. These threaded connections allow for transmission of axial and torsional drilling loads. The ID threads on the coupling 42 are designed to be weaker than the threads on the OD of the coupling 42. For example, the ID threads may have a shorter length than the OD threads. In another example, the ID threads may have a smaller diameter. In this respect, the weaker ID threads will shear before the OD threads. Since the threads are made from aluminum, the motor 50 may be retrieved by pulling it upward with overpull force and shearing the aluminum threads. The motor 50 can be retrieved, while the coupling 42 remains behind.

A spacer ring 43 is used to facilitate assembly of the bit drive assembly. The height of this spacer 43 can be selected to easily adjust the axial space-out distance between the casing bit 40 and the motor output shaft 62.

A threaded locking ring 44 is positioned above the aluminum coupling 42. It may be used as a jam-nut to effectively prevent the OD threads on the coupling 42 from loosening during the drilling process.

Drilling float valves 45 are installed in the bore of the motor output shaft 62. As shown, a tandem set of float valves 45 are used, although one or three or more float valves may be used. The float valves 45 provide a pressure barrier to prevent u-tubing of drilling fluid or cement, when the pumps are not circulating fluid down the drillstring. A stop sub 146 is threaded into the bottom of the output shaft 62. This sub 146 prevents the float valve(s) 45 from falling out.

The upper end of the casing bit 40 does not come into direct contact with the casing sub 25. A small clearance gap 47 is present between these two components 25, 40. An optional rotating sealing element could be positioned in this gap 47. In one embodiment, the gap 47 may include a "leaking trash barrier". This trash barrier includes a tortuous path or labyrinth geometry. The trash barrier will allow fluid to leak through it, but larger particles such as formation cuttings, cannot freely cross through this barrier.

To further aid in preventing formation cuttings from entering this gap 47, a positive pressure port may be used. This port directs a small portion of the drilling fluid into the cavity 48 above the aluminum coupling 42. In this manner, pressure and fluid flow is constantly directed to travel from inside the cavity to the borehole annulus. This positive pressure and flow makes it less likely that formation cuttings can enter from the borehole annulus.

Figure 5:
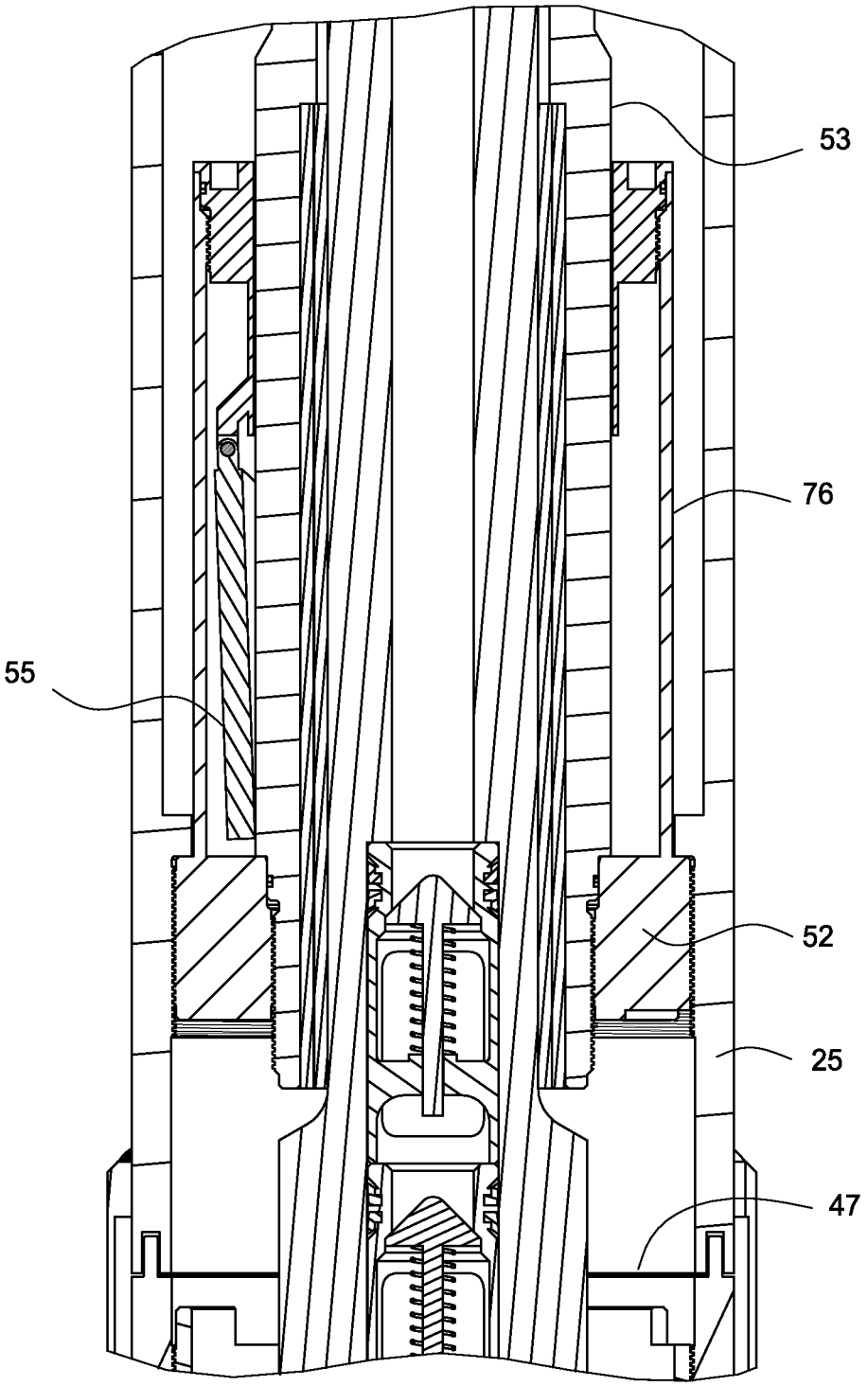

As shown in FIG. 5, a second drillable coupling 52 is used to releaseably connect the motor housing 53 to the non-rotating casing sub 25. Similar to the first, lower coupling 42, this upper coupling 52 has threads on the OD and ID for transmitting axial and torsional loads. Threads on the OD of the coupling 52 are secured to the non-rotating casing sub 25. The threads on the ID of the coupling 52 are secured to the motor housing 53. The ID threads on the coupling 52 are designed to be weaker than the threads on the OD of the coupling 52, as discussed above. Since the threads are made from aluminum, the motor 50 may be retrieved by pulling it upward with overpull force and shearing-out the aluminum threads. The motor 50 can be retrieved, while the coupling 52 remains behind.

A secondary flapper float valve 55 is positioned above the upper coupling 53. The flapper float valve 55 may be similar in form to a downhole deployment valve. The float valve 55 may be integral to the upper coupling 52 via an extension sleeve 76 as shown below to facilitate assembly. However, this flapper float valve 55 may also be completely separate from the upper coupling 52.

The flapper of the float valve 55 is held in the open position while the motor 50 is installed. The motor 50 is positioned such that it passes through the bore of the float valve 55, thus preventing the spring loaded flapper from pivoting to the closed position. The secondary float valve 55 remains in the open position during the drilling and cementing processes.

Figure 6:
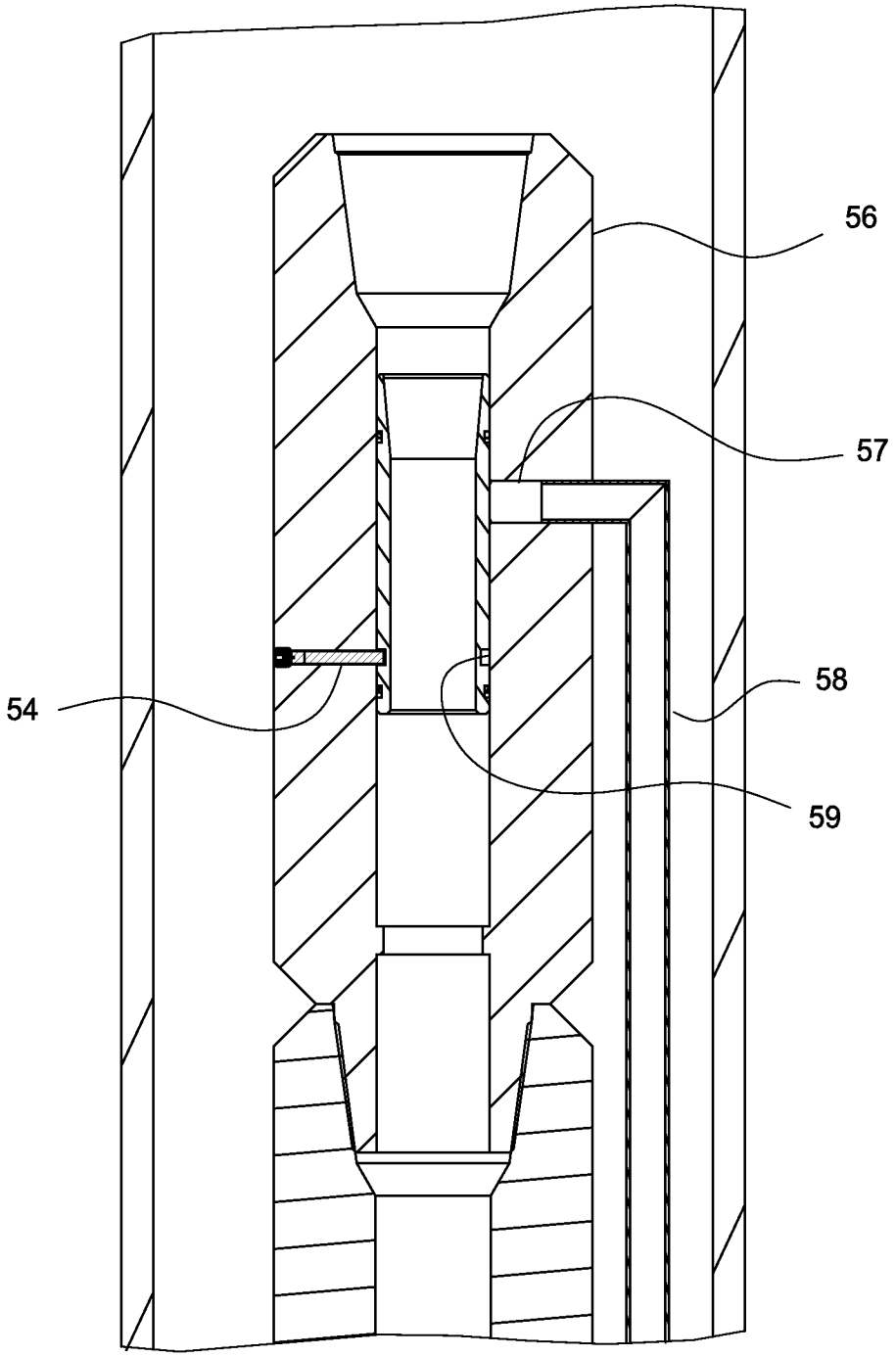

After drilling to target depth ("TD") and landing the high pressure wellhead 12, the cementing process can begin. Prior to pumping cement, the flow path in the bit drive assembly is changed, so that cement flow will be directed around the drilling motor 50 as opposed to through the drilling motor 50. In one embodiment, a diverter mechanism is installed on the top of the motor 50, as shown in FIG. 6. The diverter mechanism includes a diverter sub 56 that is connected to the inner string 22. The diverter sub 56 has cementing side port 57 that is in selective communication with the bore of the diverter sub 56, as shown in FIG. 6. A cementing tube 58 is connected to the side port 57 and extends downward around the motor 50. In drilling mode, the side port 57 and the cementing tube 58 are blocked by a sleeve 59. The sleeve 59 is held in position using a shearable member such as a screw 54. In this manner, the fluid flow is directed through the bore of the diverter sub 56 to the motor 50.

Figure 8:
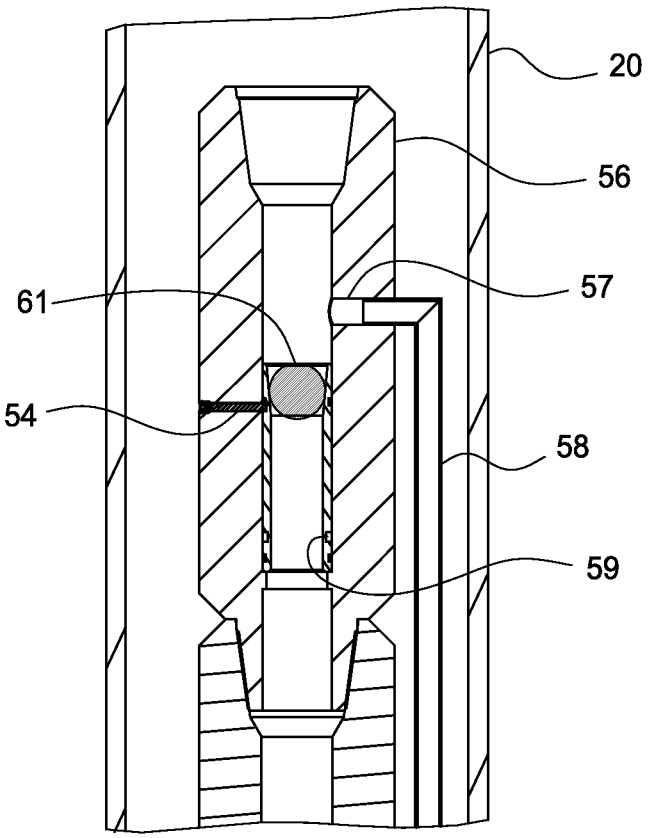
FIG. 8 shows a sequence view of the diverter mechanism in operation.

When ready to cement, a ball 61 is dropped from surface. FIG. 8 shows the ball 61 landing in the ball seat of the sleeve 59. Increasing pressure shears the shear screw 54, thereby allowing the sleeve 59 to move downward. Movement of the sleeve 59 opens the cementing port 57 and allows cement to enter the cementing tube 58. While at the same time, the ball 61 prevents cement from entering the motor 50.

Figure 7:
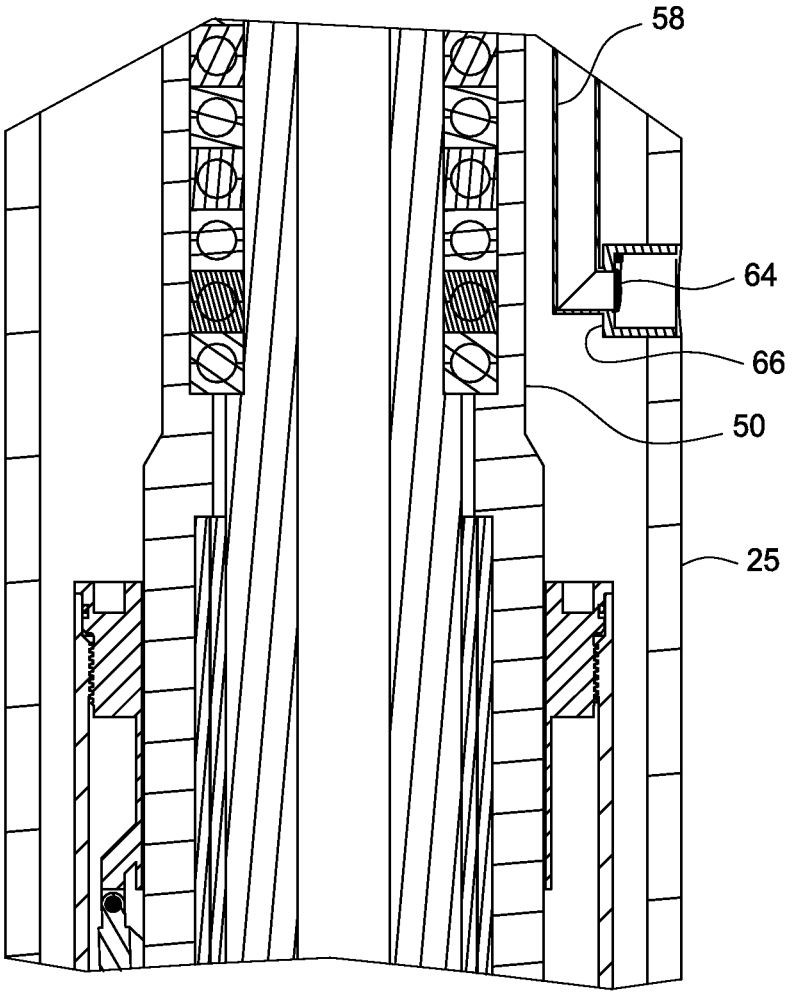

Cement is then pumped down the drillstring 5, through the inner string 22, and into the cementing tube 58. The cementing tube 58 extends downward and exits the casing sub 25 near the lower end of the motor 50, as shown in FIG. 7. The cementing tube 58 provides a path for cement to bypass the motor 50 and enter the annulus between the casing 20 and the borehole.

To prevent u-tubing of the cement, an optional small flapper float 64 is positioned near the outlet of the cementing tube 58, as shown in FIG. 7. An optional rupture disc (not shown) may be positioned between the flapper 64 and the OD of the surface casing 20 in order to prevent cuttings debris from accumulating in this space, which might hinder opening of the flapper 64.

It should be noted that the cementing tube 58 may be constructed of a rigid material (such as metal tubing) or a flexible material (such as a high pressure hose).

Figure 9:
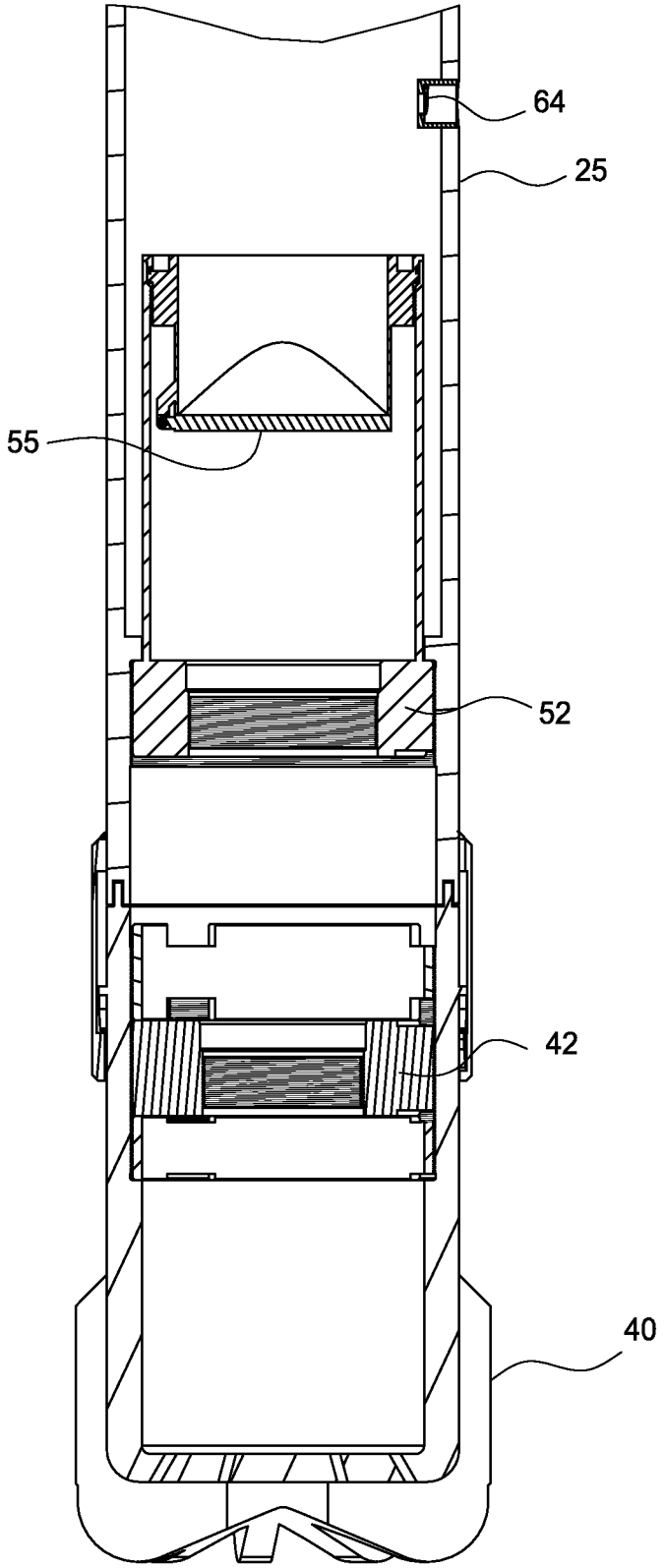
FIG. 9 shows the motor removed from the casing drilling system.

After cementing, it is desirable that the majority of the cementing tube 58 is retrieved to surface along with the drilling motor 50. In one embodiment, the lower end of the cementing tube 58 is designed to have a releasable "weak point" 66 above the flapper float 64 to facilitate shearing of the cementing tube 58 from at the lower end. As the motor 50 is retrieved, the cementing tube 58 will detach at this weak point 66. The upper end of the cementing tube 58 is retrieved with the motor 50, while the small flapper float 64 is left behind. FIG. 9 shows the motor 50 removed from the casing drilling system 100.

After drilling and cementing operations are completed, the motor 50 is retrieved up through the secondary flapper float valve 55. Once the motor 50 is no longer holding the float valve 55 in the open position, the spring loaded flapper is free to pivot to the closed position. The secondary flapper float valve 55 remains in place after the motor 50 is retrieved and acts as a secondary pressure barrier. This barrier feature may act as a safety feature such as in the event of a poor quality cement job at the casing shoe.

After the motor 50 is retrieved, the casing bit 40 is no longer coupled to the casing sub 25. In ideal conditions, a good cement job at the casing shoe will prevent the casing bit 40 from spinning freely as it is drilled-out in subsequent operations. If the casing bit 40 is not rotationally constrained, the drill-out process may be problematic. In the event of a poor quality cement job, or "wet shoe", the casing drilling system includes a mechanical feature that provides a contingency mechanism for rotationally locking the casing bit 40 to the casing sub 25. Locking these two components allows the casing bit 40 to be drilled-out more easily, since rotation of the casing bit 40 is prevented.

Figure 10:
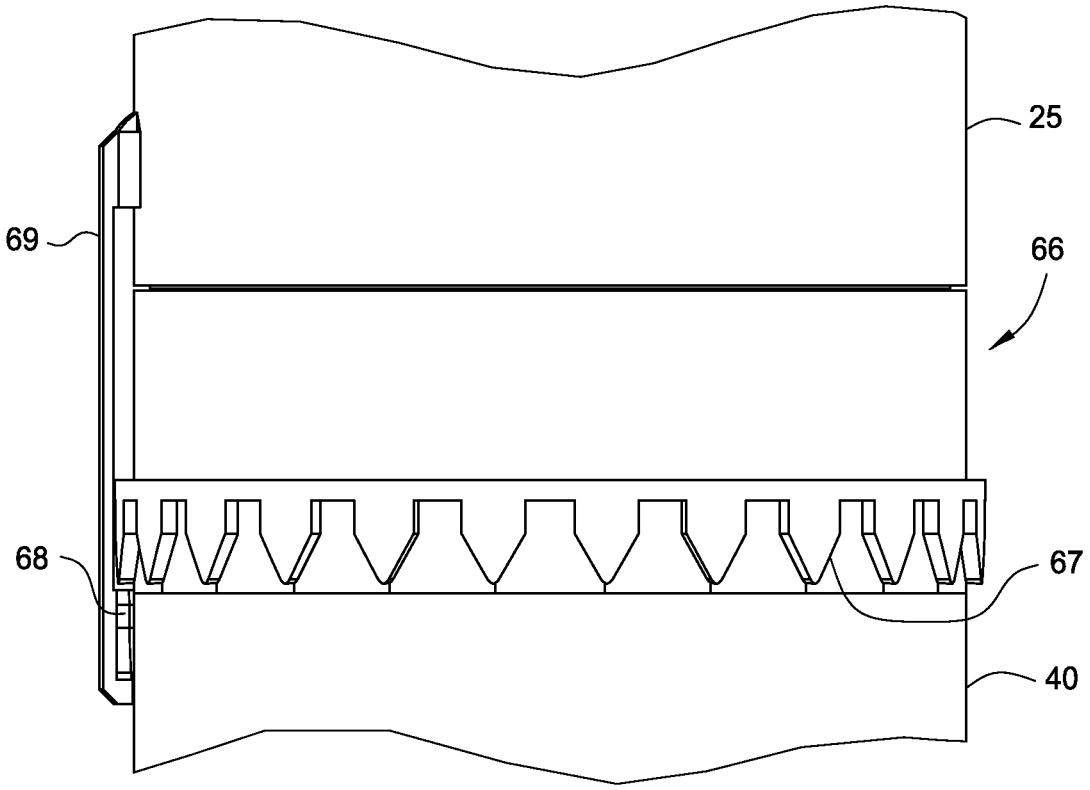
FIG. 10 illustrates an embodiment of a locking mechanism.

Referring now to FIG. 10 the mechanical feature includes a lock 66 having mating teeth 67, 68. One set of teeth 67 is provided in the OD of the casing bit 40, such as by machining the teeth 67 into the OD. Mating teeth 68 are provided on locking segments 69 that are preferably attached to the non-rotating casing sub 25. For example, the locking segments 69 may be welded to the non-rotating casing sub 25. As shown, three locking segments 69 are used, however, any suitable number, such as two or four, of segments may be used. The mating teeth 68 may be machined onto the locking segments 69.

The teeth 67 on the casing bit 40 and the teeth 68 on the locking segment 69 are arranged such that an axial gap is present between the two sets of teeth 67, 68 when the motor 50 is installed. The gap prevents the two sets of teeth 67, 68 from coming in contact (and locking the casing bit 40) as the surface casing 20 is drilled in place. After the motor 50 is retrieved, the casing bit 40 can move downward so that the locking teeth 67 on the casing bit 40 move toward the locking teeth 68 on the locking segment 69. After closing the gap, the two sets of teeth 67, 68 come in contact, thereby rotationally locking the casing bit 40 for drill-out.

In instances where the cutting structure of the casing bit 40 is resting on firm formation, an axial gap between the teeth 67, 68 may still be present, even after the motor 50 is retrieved. It is anticipated that during the subsequent drill-out operation, the drill-out bit would contact the internal face of the drillable casing bit 40. As weight on bit is applied to the drill-out bit, it would urge the casing bit 40 deeper, possibly causing the casing bit 40 to drill a small amount of new formation, perhaps only a fraction of one inch. This would allow the casing bit 40 to move downward slightly, so that the locking teeth 67, 68 would eventually come in contact and prevent further rotation of the casing bit 40. After rotational locking is achieved, the casing bit 40 can be easily drilled out with the drill-out bit.

Figure 11:
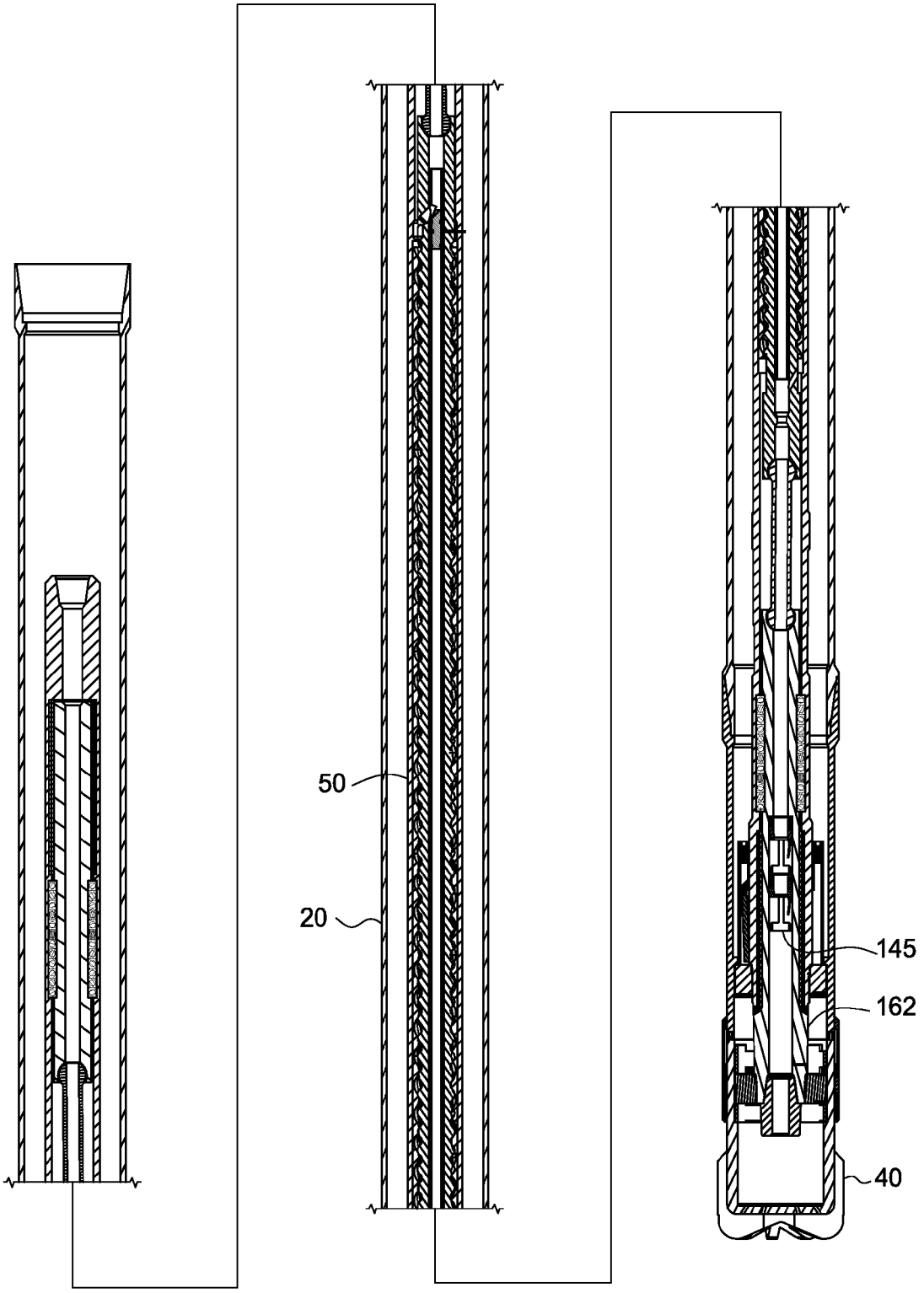
FIG. 11 illustrate another embodiment of a casing bit drive assembly.

FIG. 11 illustrate another embodiment of a casing bit drive assembly. This embodiment contains many similarities to the embodiment shown in FIG. 2. Therefore, for sake of clarity, only the differences will be discussed below. In must be noted that features taught in one or more embodiment described herein may be suitably used with another other embodiment described herein. FIGS. 12-18 illustrate enlarged partial views of FIG. 11. The casing bit drive assembly contains features that allow for cementing through the drilling motor 50 as opposed to cementing around the motor 50. In one embodiment, the cement travels through the motor 50 and into the cavity below the motor 50. The cement then exits the nozzles in the casing bit 40 and enters the annulus between the casing 20 and the borehole.

Figure 12:
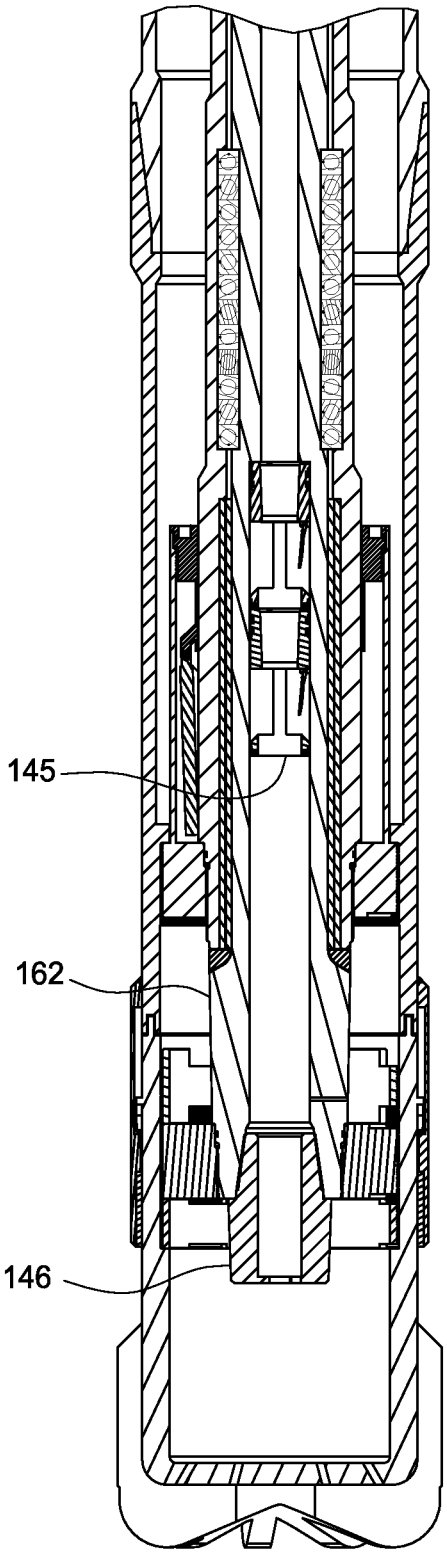
FIGS. 12-18 illustrate enlarged partial views of FIG. 11.
Figure 13:
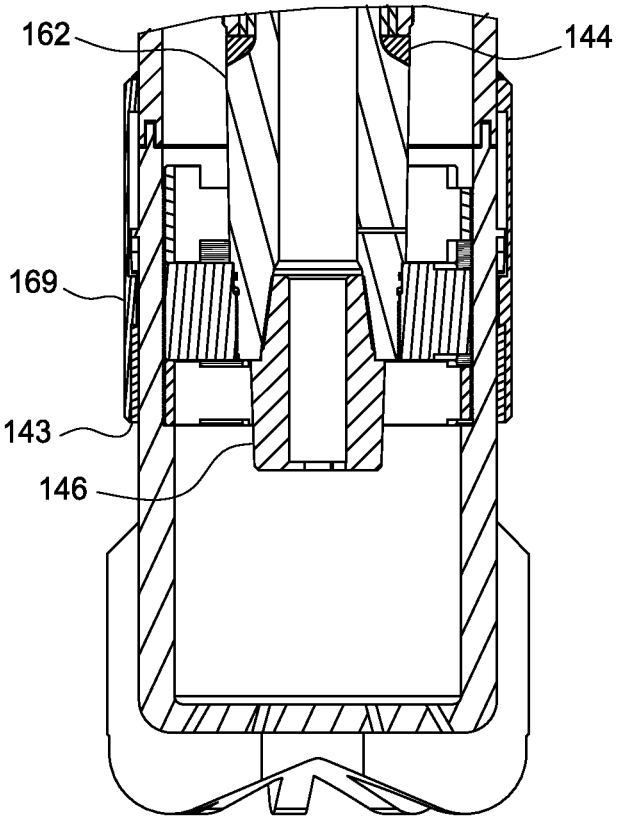
Figure 14:
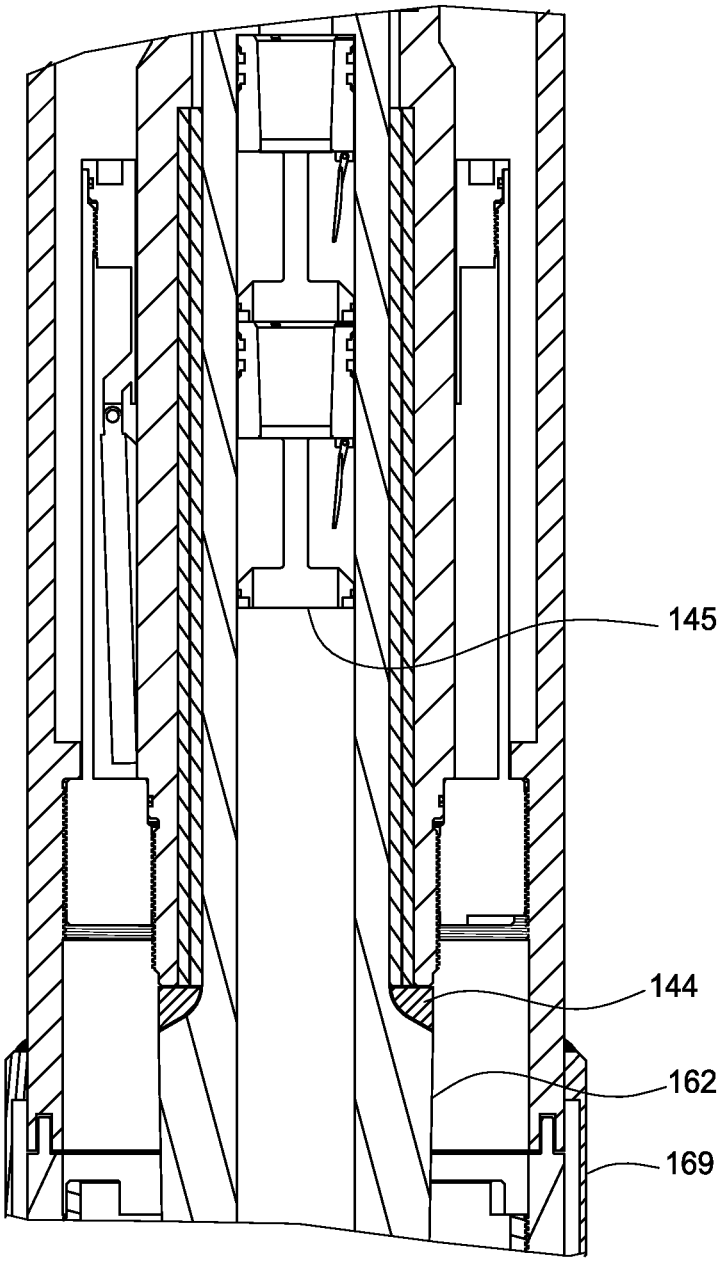
Figure 15:
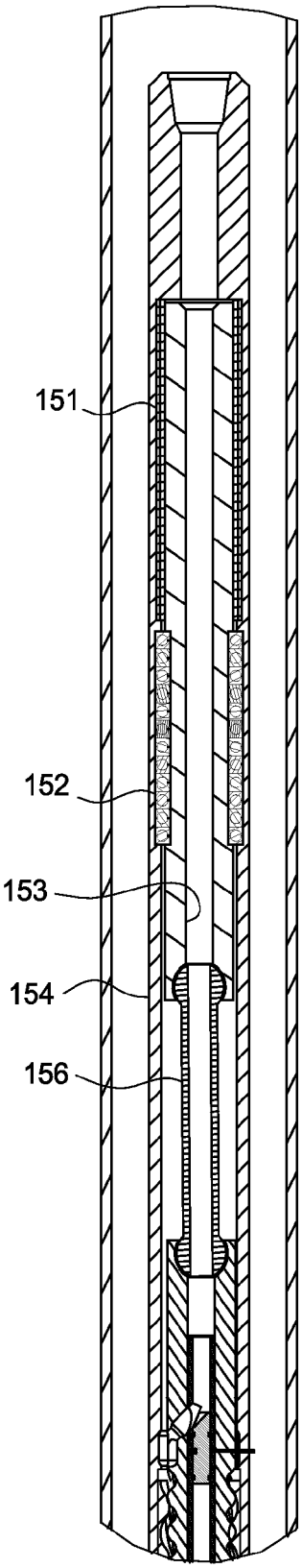

In order to prevent the lower end of the motor 50 from getting stuck in the cement, the casing bit drive assembly shown in FIGS. 12-14 is provided with one or more of the following features: tapered OD on the stop sub 146, tapered OD on the motor output shaft 162, and a ring 144 around the neck of the motor output shaft 162. In addition, these surfaces may optionally be coated with a non-stick surface treatment. Exemplary coating material includes Teflon, Impreglon, quench polish quench, and combinations thereof. The non-stick treatment will allow the outer portions of the motor 50 exposed to cement to be more easily retrieved.

The tandem drilling float valves in the bore of the output shaft 162 have been changed from plunger-type float valves to flapper-type float valves 145. The flapper float valves 145 will allow balls, pistons, and other larger components to pass through and exit the hollow bore motor 50, before getting trapped in the stop sub 146 at the lower end of the motor 50.

A marine-type radial bearing 143 may be provided on the ID of the non-rotating locking sleeve segments 169, as shown in FIG. 13. This bearing 143 rides against the OD of the rotating casing bit 40. In one embodiment, the bearing 143 may be molded into the locking sleeve segments 169. The bearing 143 provides added radial support to the casing bit 40 during the drilling process. Although the marine bearing 143 does not provide a true sealing surface, it will help prevent formation cuttings in the borehole from entering the assembly.

Figure 16:
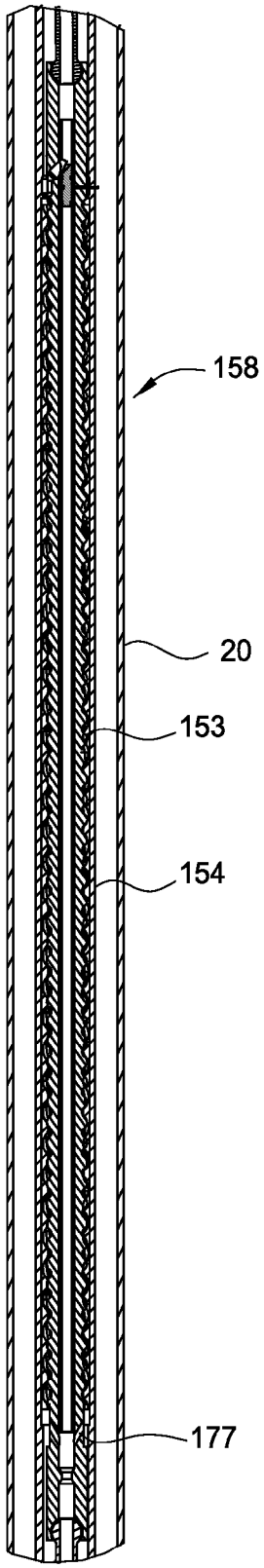
Figure 17:
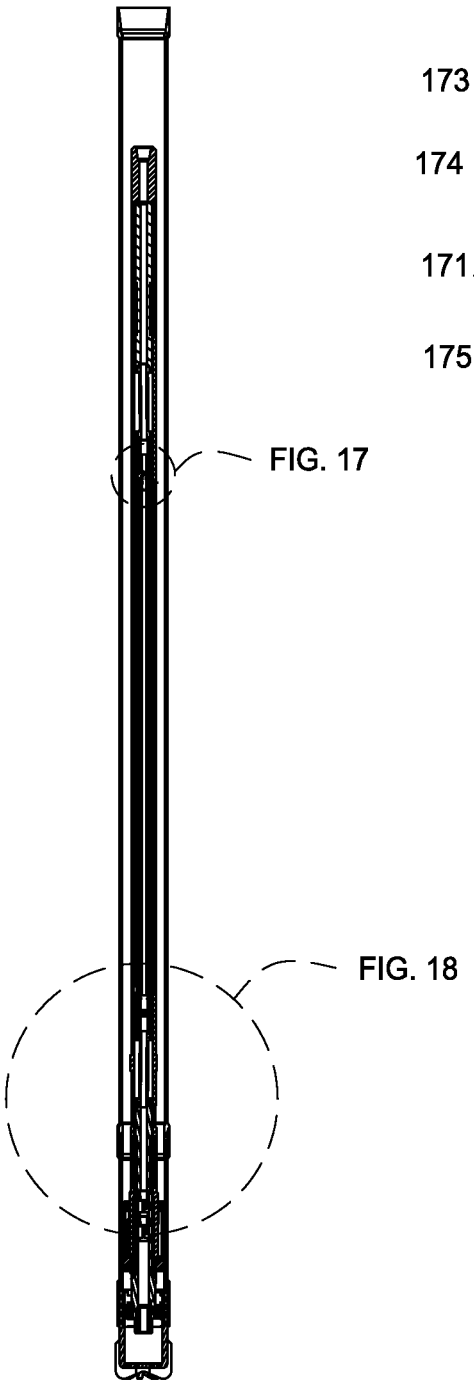
Figure 17:
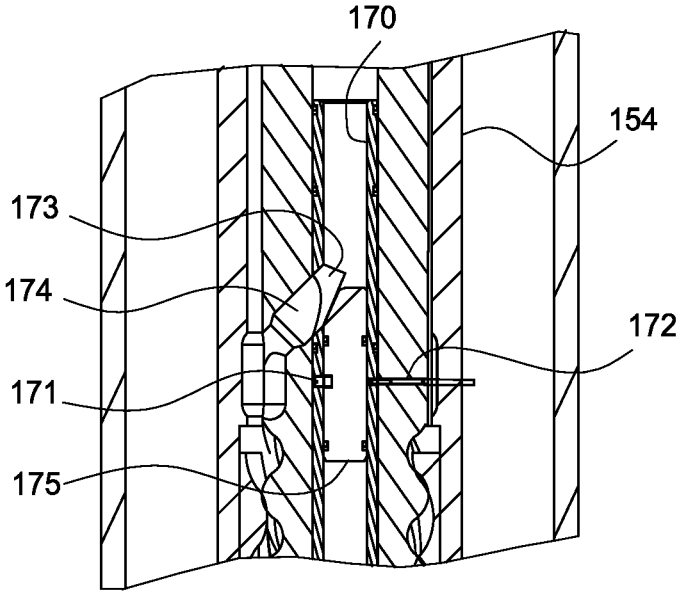

FIGS. 15-18 are enlarged views of the motor 50. The top of the motor 50 connects to the inner string 22. The upper portion of the rotor 153 is coupled to the stator 154 using axial and radial bearings 151, 152. An optional upper flex shaft 156 couples the bearing section to the power section 158 of the rotor 153. The power section 158 of the rotor 153 has a hollow bore extending therethrough. Referring to FIG. 17, a flow tube 170 and a diverter piston 175 are disposed in the bore. The diverter piston 175 is held in the flow tube 170 using a first shearable member 171 and blocks fluid flow through the flow tube 170. The flow tube 170 is held in the bore using a second shearable member 172. The second shearable member 172 is configured to shear at a lower force than the first shearable member 171. In drilling mode, the drilling fluid enters the top of the drilling motor 50. Ports 173 in the tube 170 are aligned with entry ports 174 in the rotor 153. When these ports 173, 174 are aligned, the ports 173, 174 are in the open position to allow flow to enter the top portion of the power section 158 between the OD of the rotor 153 and the ID of the stator 154. This provides power to cause rotation of the rotor 153. The diverter piston 175 prevents fluid from travelling down through the bore of the flow tube 170.

Figure 18:
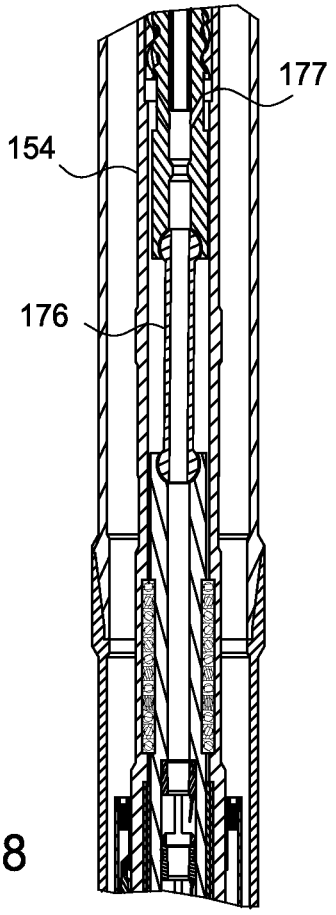

As shown in FIGS. 16 and 18, at the lower end of the power section 158, fluid flow can exit the power section 158 and re-enter the bore via port 177 to continue flowing downward to the motor output shaft 162. The lower end of the rotor 153 also includes an optional lower flex shaft 176 to facilitate transfer of torque to the output shaft 162 and includes axial and radial bearings.

Figure 19:
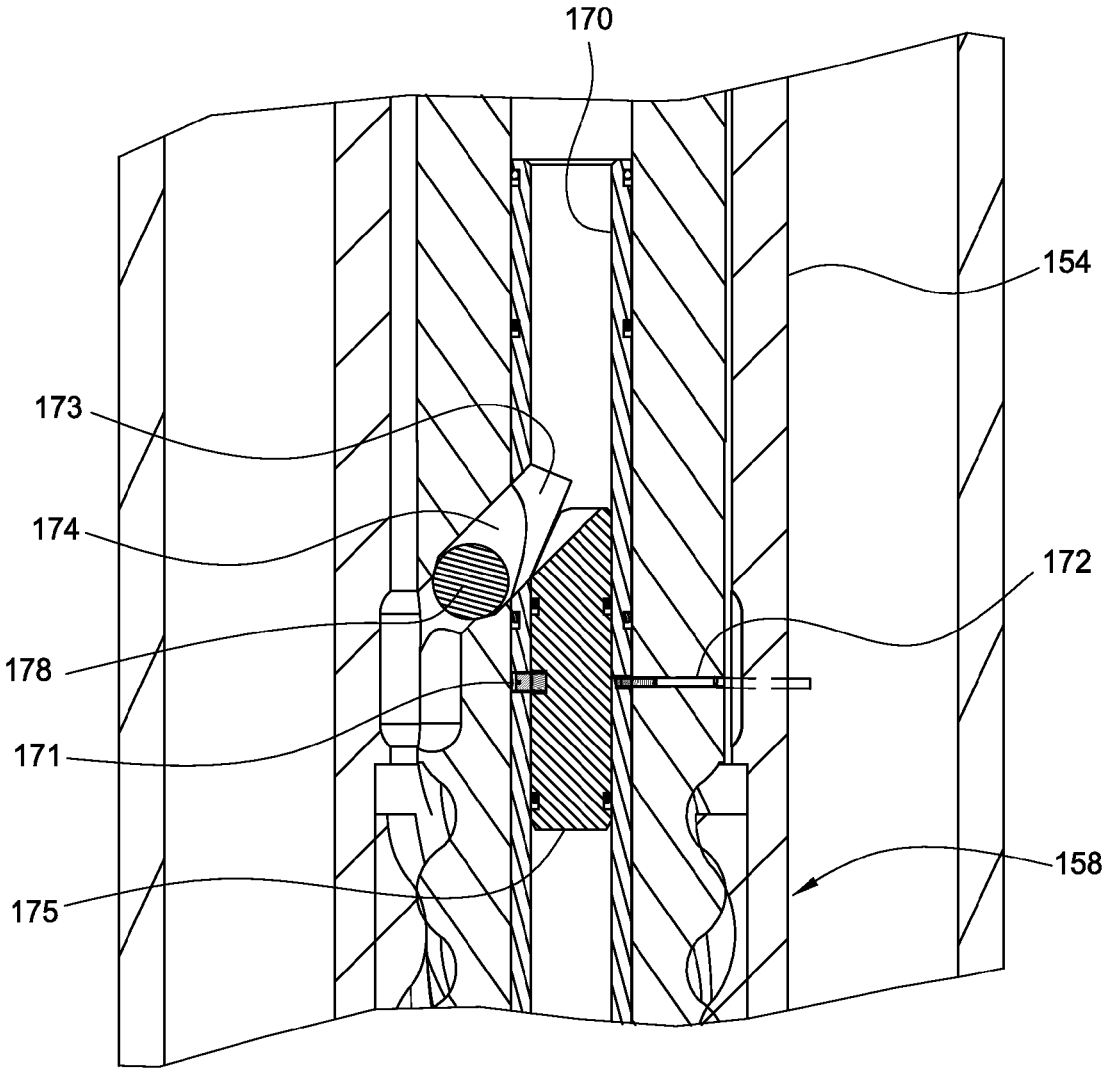
FIGS. 19-23 are sequential views of the diverter mechanism of FIG. 11 in operation.
Figure 20:
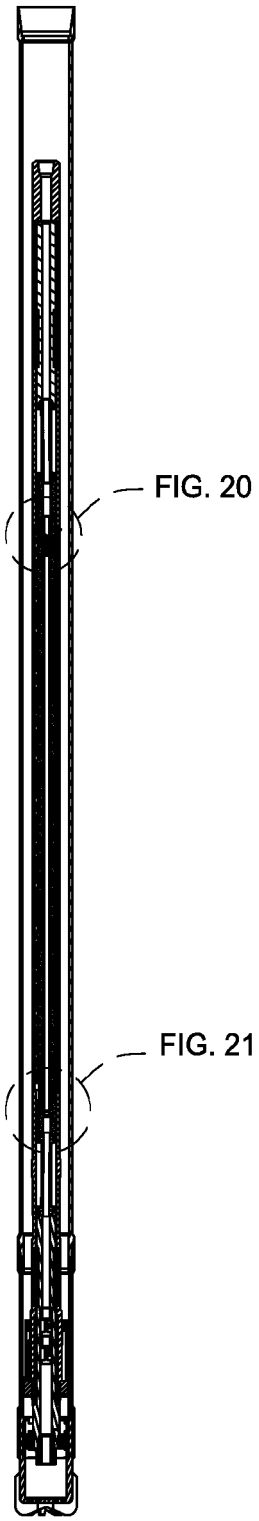
Figure 20:
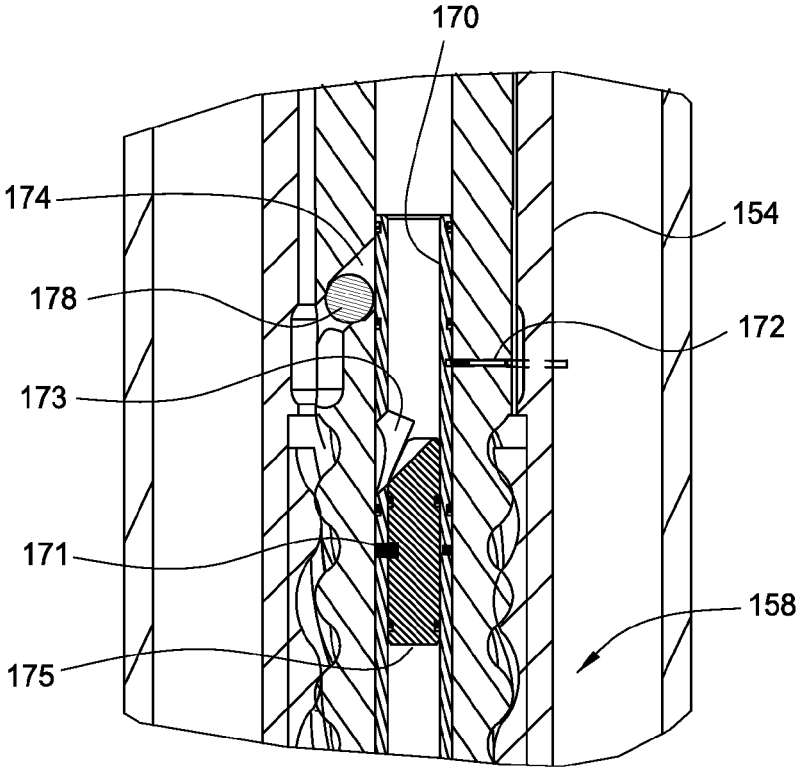
Figure 21:
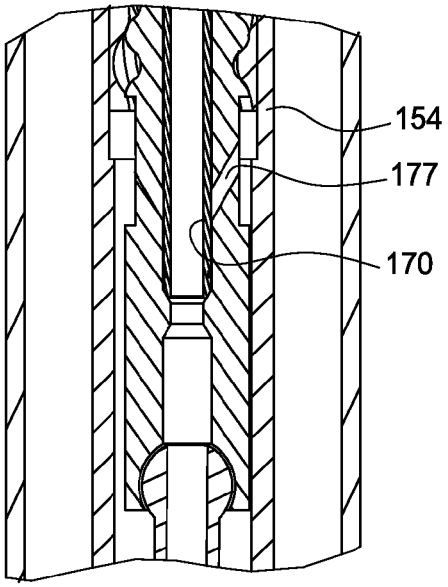

Referring to FIG. 19, after drilling is completed, a ball 178 can be dropped to alter the flow path through the motor 50 for cementing purposes. The ball 178 seats in the entry port 174 of the power section 158 and effectively blocks the fluid path to the power section 158. As pressure is increased in FIG. 20, the "weaker" shear screws 172 connecting the flow tube 170 to the rotor 153 are sheared out, thereby shifting the tube 170 downward. This downward movement causes the flow tube 170 to seal off the entry ports 174 to the power section 158. This downward movement also causes the flow tube 170 to seal off the exit ports 177 from the power section 158, as shown in FIG. 21. As a result, fluid and cement can no longer enter the power section 158. This blockage protects the expensive power section 158 from being damaged as a result of hardened cement.

Figure 22:
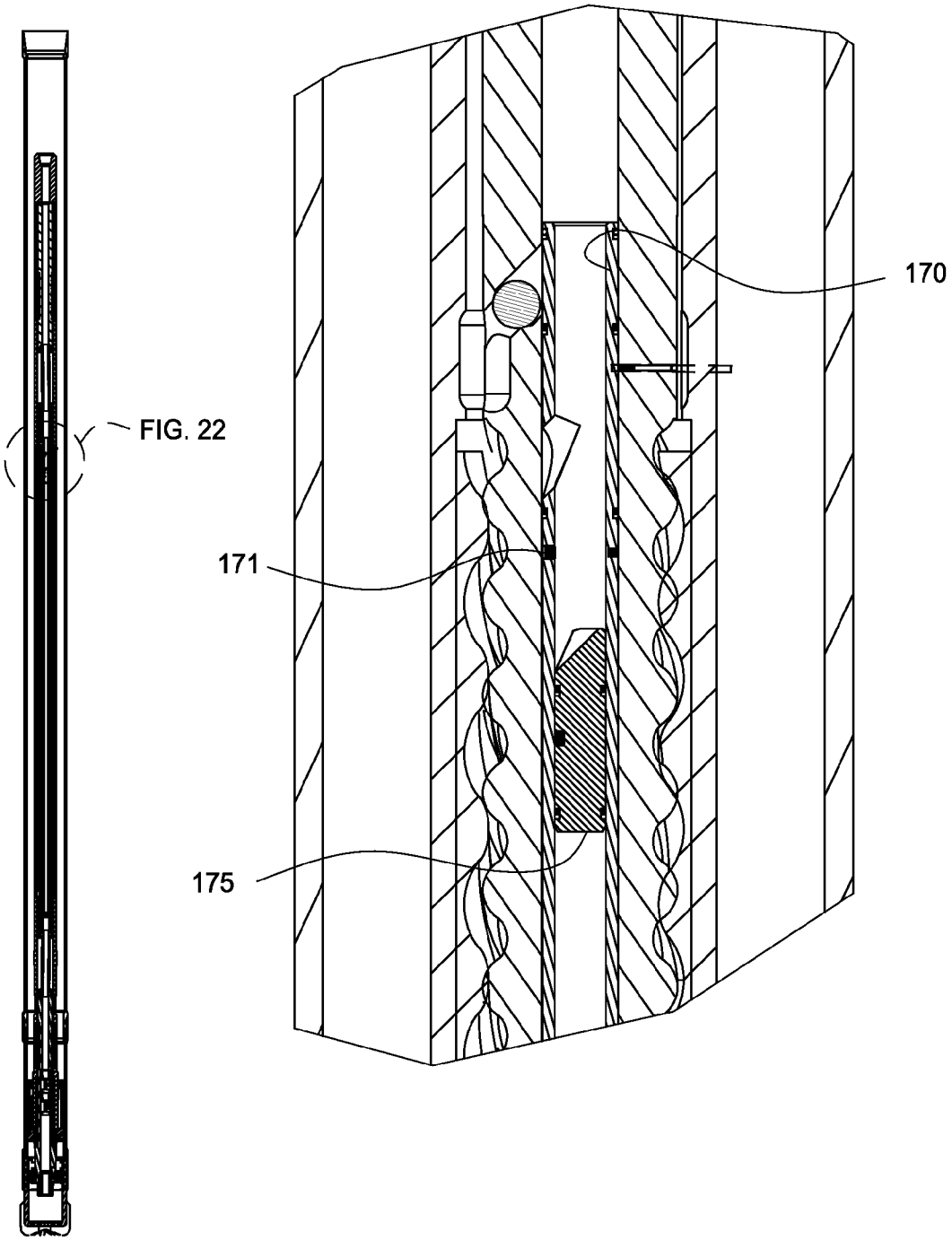
Figure 23:
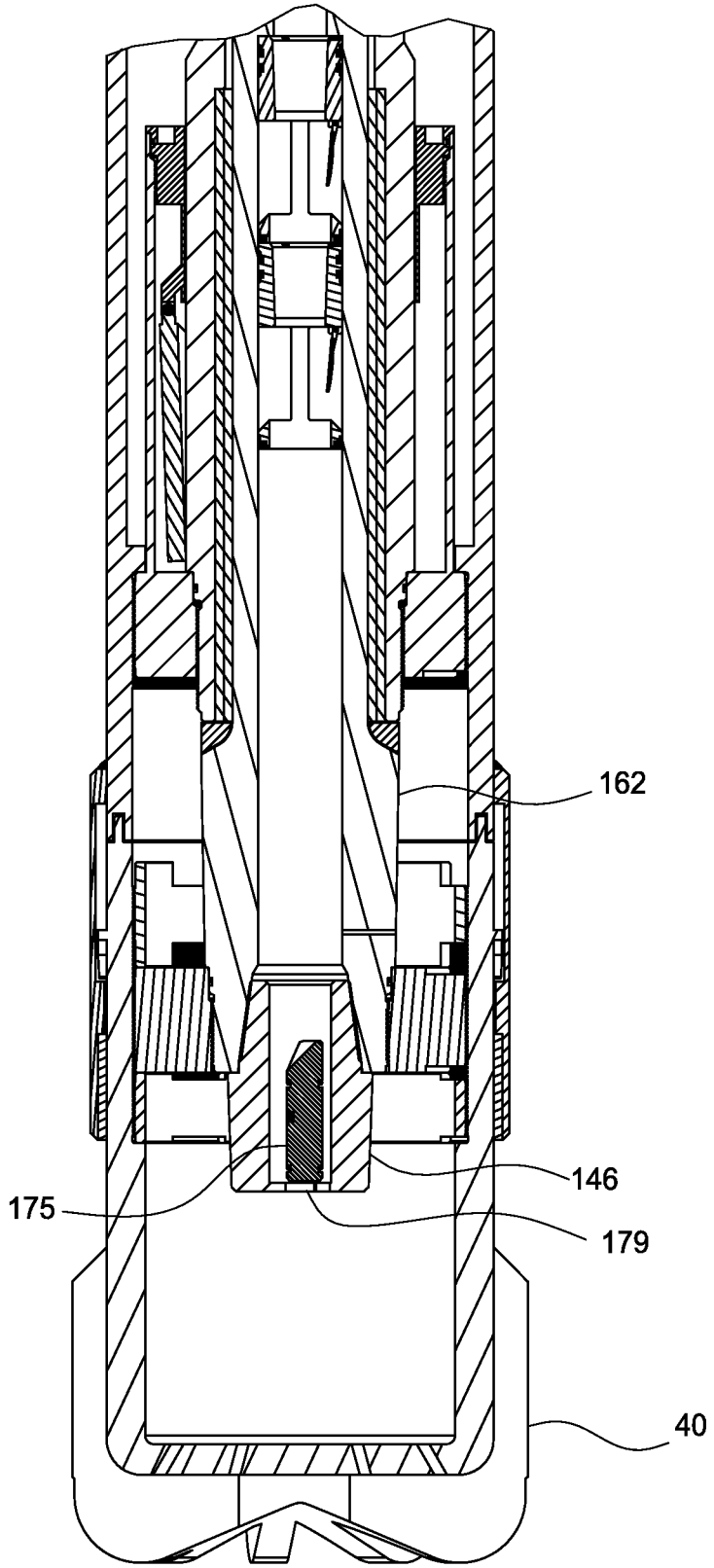
Figure 24:
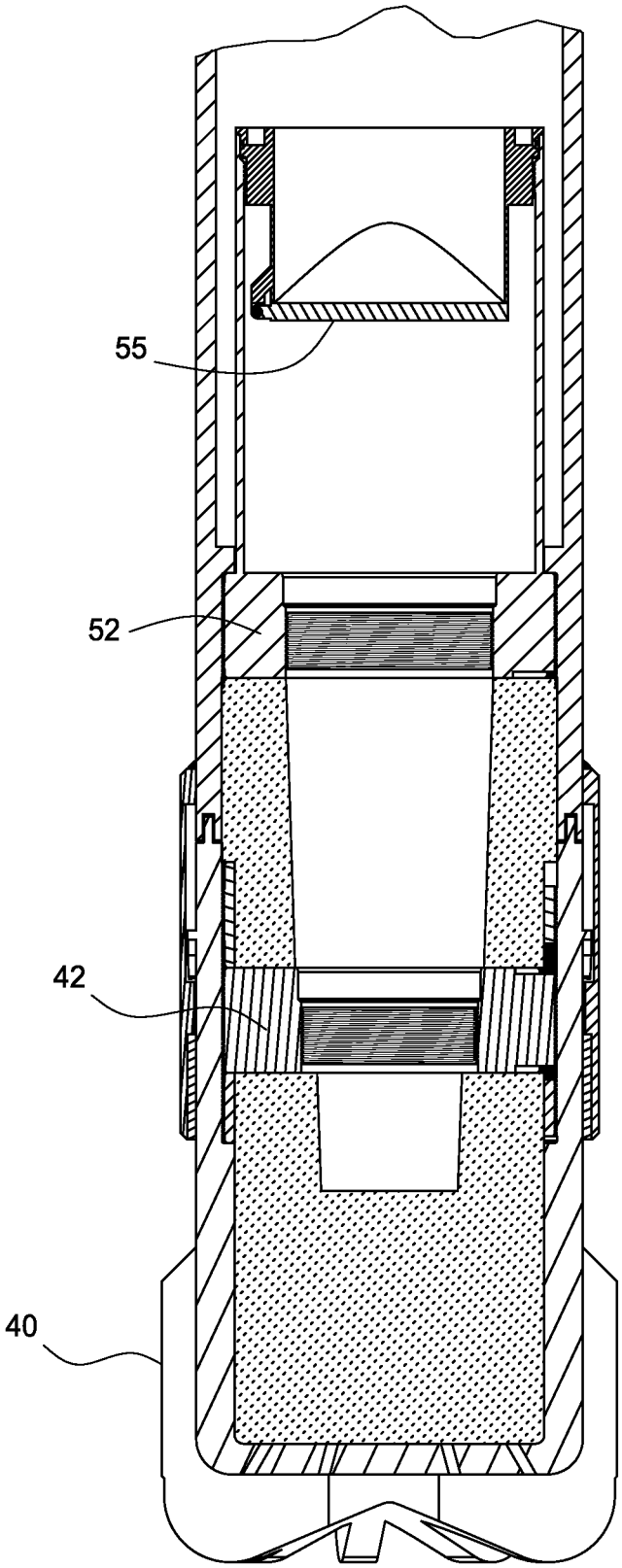
FIG. 24 shows the motor removed from the bit drive assembly of FIG. 11.

After the tube 170 has shifted downward, the pressure can be further increased in order to shear out the "stronger" shear screw(s) 171 that retains the diverter piston 175 against the flow tube 170, as shown in FIG. 22. The diverter piston 175 is then forced though the tube 170, and out of the motor 50. The stop sub 146 below the motor 50 traps the diverter piston 175 as it exits the motor 50, shown in FIG. 23. One or more holes 179 in the stop sub 146 allow fluid and cement to pass through while keeping the diverter piston 175 trapped. An open circulation path is now available for cementing, while the power section 158 remains sealed from fluid flow. FIG. 24 shows the casing bit assembly after cementing. The motor 50 has been removed by pulling up and shearing from the thread couplings 42, 52. Also, the flapper float valve 55 has closed after removal of the motor 50.

In some instances, although unlikely, while drilling-in the surface casing 20, the motor's power section 158 could become worn out. If this were to happen, the motor 50 would no longer be able to provide sufficient rotation and torque to continue drilling. In the event of a worn power section 158, it may be desirable to continue drilling ahead. A contingency motor lock-out feature is provided so that drilling can continue by rotating the entire casing string 20 and casing bit 40 together from surface. The motor lock-out must be done prior to dropping the cementing ball and shifting the cementing tube 170.

Figure 25:
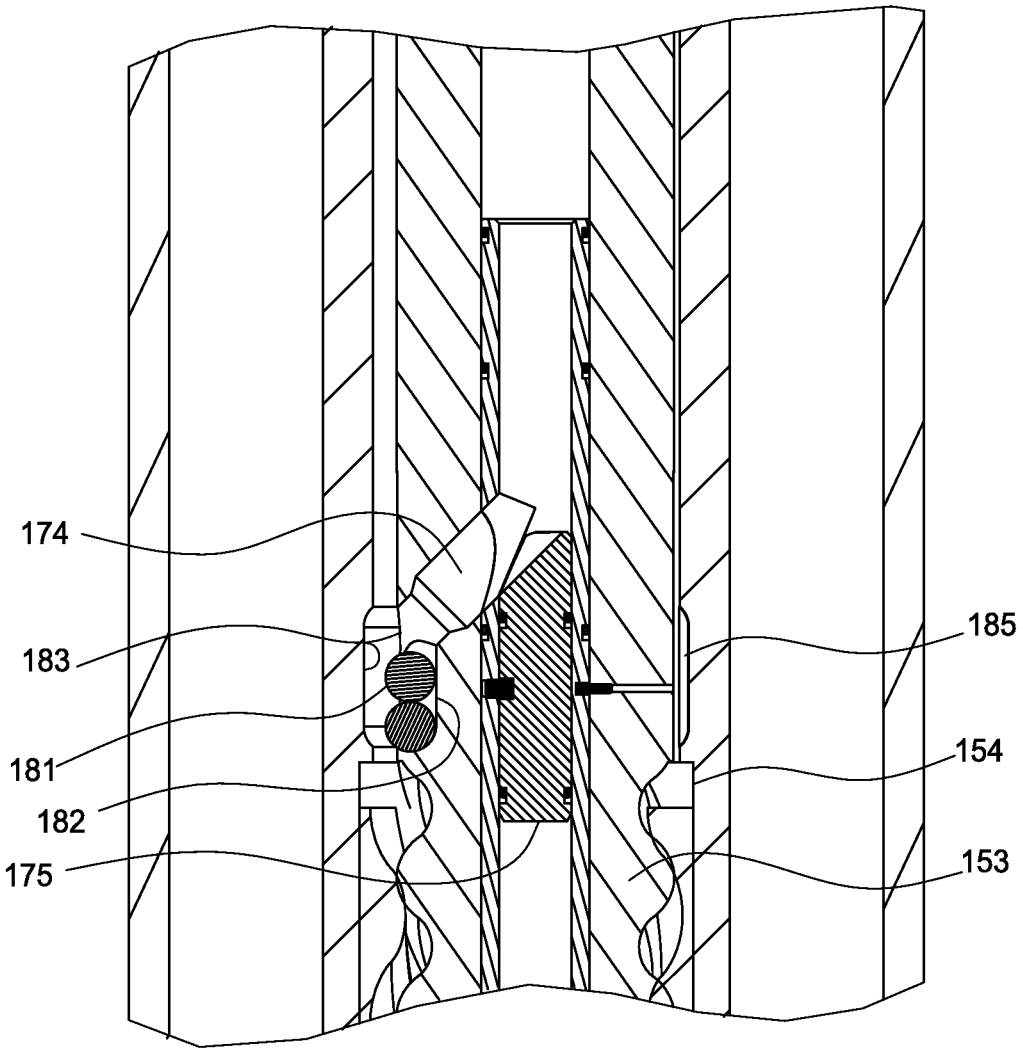
FIGS. 25-27 are sequential views of an embodiment of a lock-out mechanism for the motor in operation.

Referring to FIG. 25, to rotationally lock the motor 50, one or more lockout balls 181 are dropped from surface. The lockout balls 181 are smaller is size than the ball 178 dropped to begin the cementing process. The lockout balls 181 travel though the drillstring 5 and enter the top of the motor 50. When the balls 181 contact the diverter piston 175, they are directed through the entry port 174 of the power section 158. The balls 181 are seated in a space formed between a recess 182 of the OD of the rotor 153 and a recess 183 in the ID of the stator housing 154. The recess 183 may be machined into the ID of the stator housing 154 and is not a full 360° recess 183. Rather, the machined recess 183 is an arc of less than 360°. This results in a shoulder 185 that remains in the circular path.

Figure 26A:
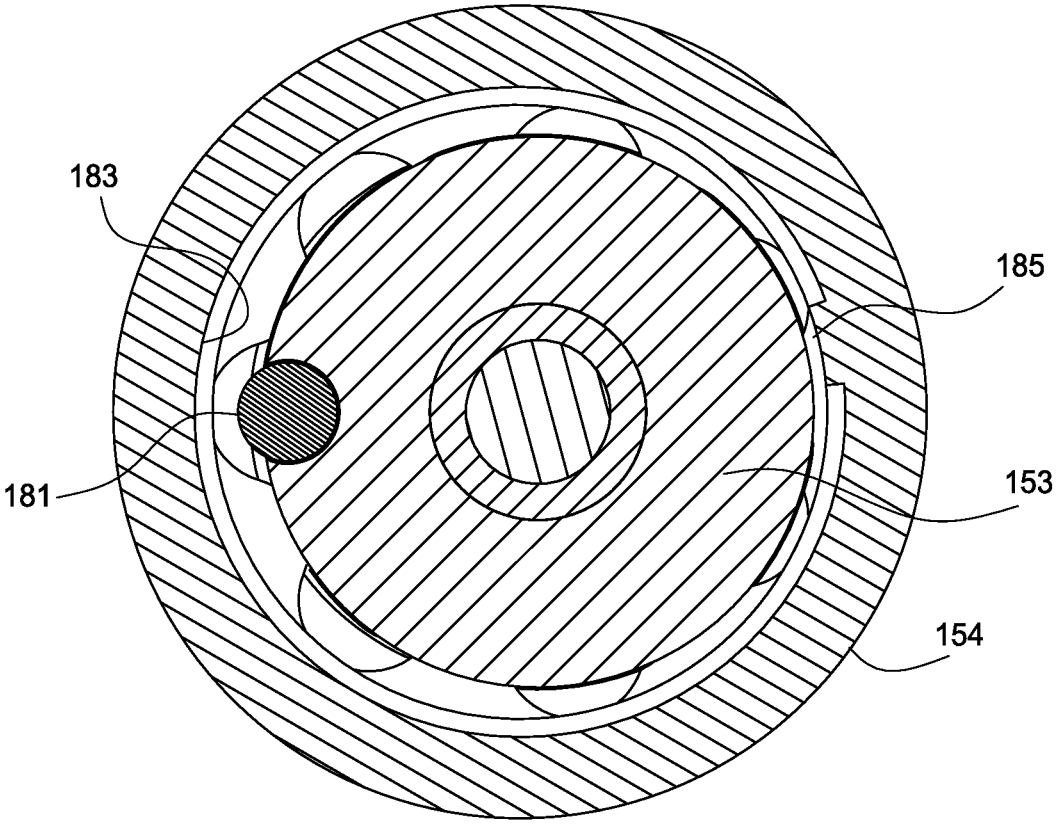
Figure 26B:
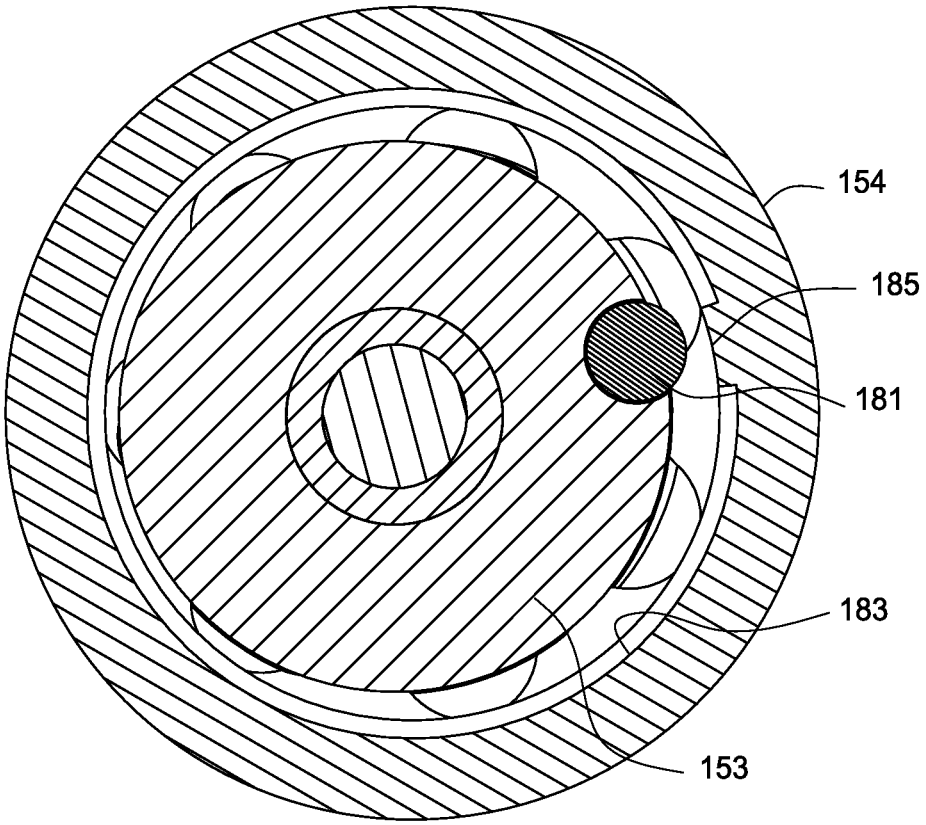
Figure 27:
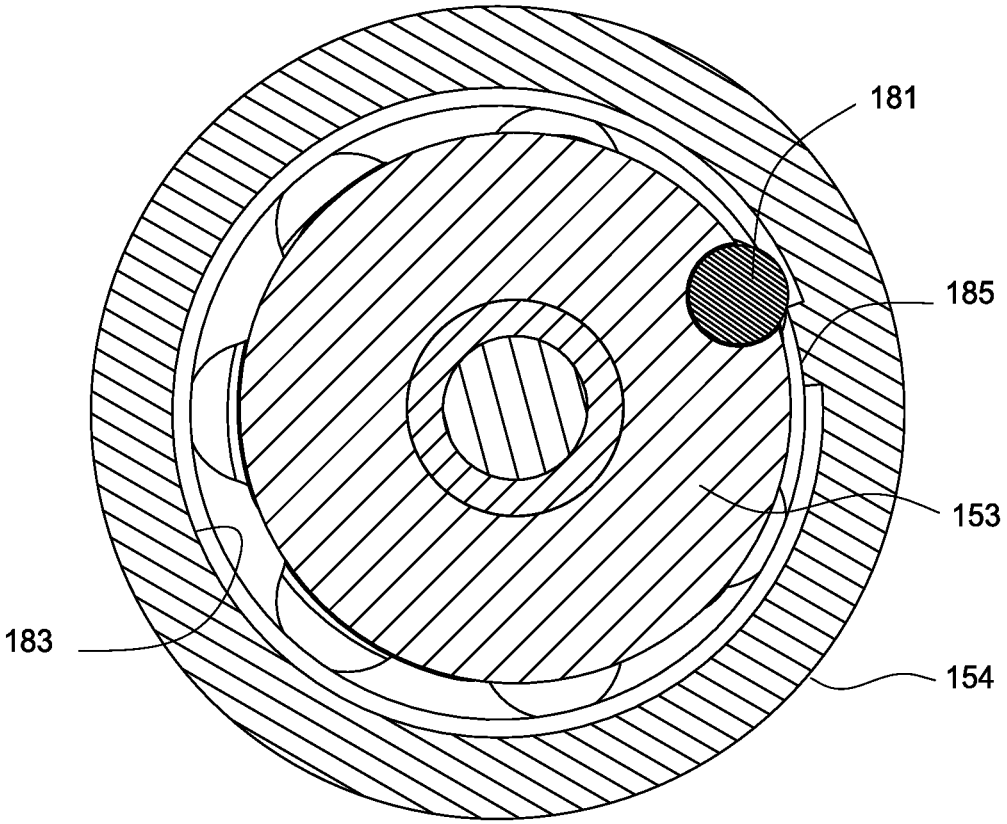

Referring to FIGS. 26A-B and 27, after the balls 181 have been seated, pump pressure will cause the rotor 153 to begin turning. Because the balls 181 are trapped in the rotor 153, they will rotate together with the rotor 153. During rotation, the balls 181 will eventually come in contact with the shoulder 185 in the recess arc of the stator housing 154. At this point, the motor 50 is effectively locked and can no longer rotate.

It should be noted that the rotation of the rotor 153 in relation to the stator housing 154 is eccentric. The degree of eccentricity or nutation is dependent upon several factors, including the lobe configuration of the drilling motor 50. Depending on the amount of eccentricity or nutation, it may require several revolutions before the balls 181 come in contact with the shoulder 185 of the stator housing's recess 183, as shown in FIG. 27.

Figure 28:
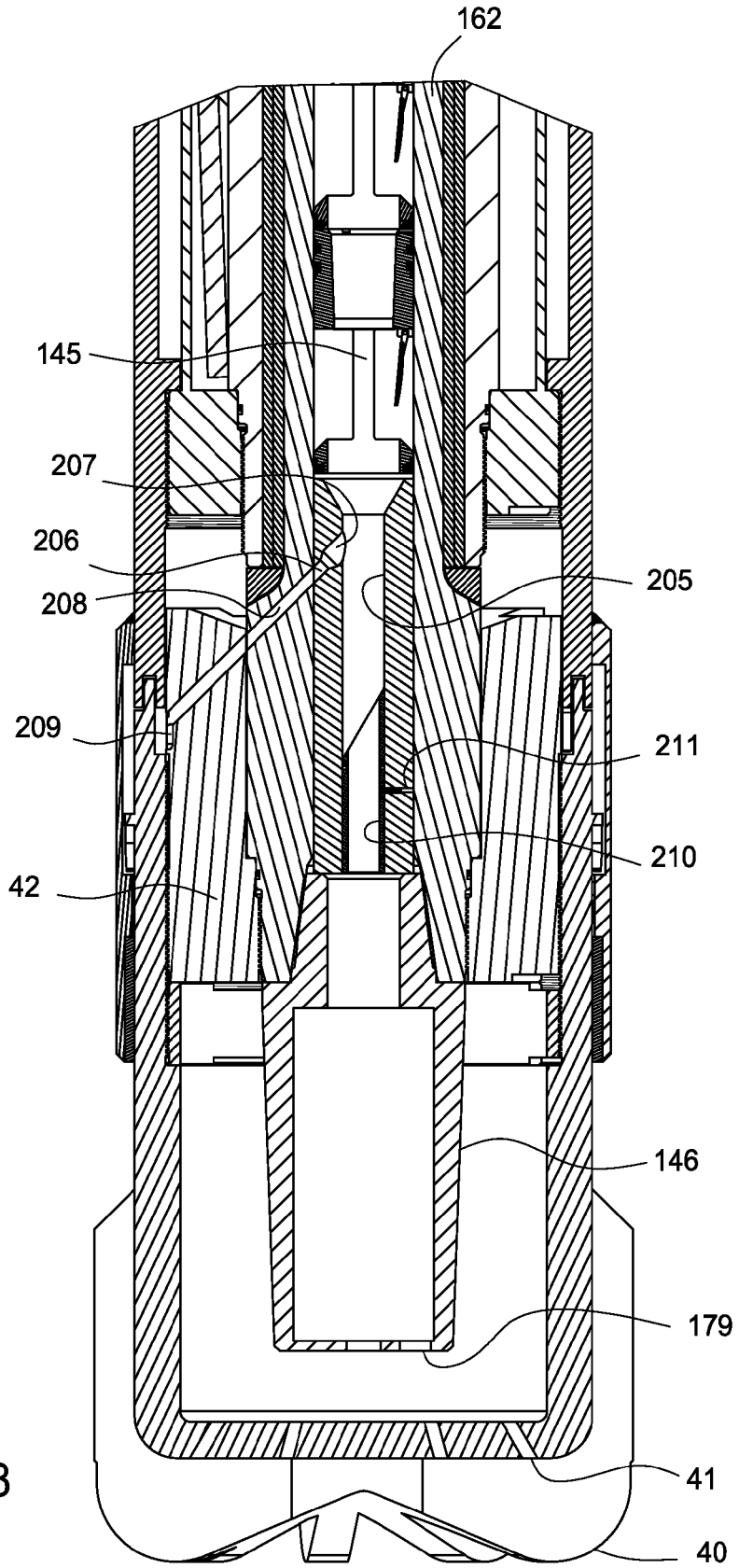
FIG. 28 illustrate another embodiment of the casing bit drive assembly.

FIG. 28 illustrate another embodiment of the casing bit drive assembly. This embodiment contains many similarities to the embodiments shown in FIGS. 2 and 11. Therefore, for sake of clarity, only the differences will be discussed below. In must be noted that features taught in one or more embodiment described herein may be suitably used with another other embodiment described herein.

In one embodiment, the casing bit drive assembly includes a locking mechanism for rotationally locking the casing bit 40, for example, immediately prior to pumping cement. The locking mechanism may act as a contingency locking mechanism to prevent the casing bit 40 from rotating during the drill-out process.

As shown in FIG. 28, a guide sleeve 205 and muleshoe tube 210 are installed in the bore of the motor output shaft 162. The guide sleeve 205 abuts the stop sub 146 and prevents the float valves 145 from falling out. The upper end of the guide sleeve 205 is tapered like a funnel to help direct the diverter piston 175 into the guide sleeve 205. The guide sleeve 205 also has a ball seat 206 and angled port 207 which is aligned with complementary ports 208 in the motor output shaft 162 and the recess 209 in the lower aluminum coupling 42.

The muleshoe tube 210 is releaseably connected to the guide sleeve 205 using a shear screw 211. The angled surface on the top end of the muleshoe tube 210 is designed to mate with the lower end of the diverter piston 175. This angled surface will be used to rotationally align the diverter piston 175 with the angled port 207 and ball seat 206.

In drilling mode of FIG. 28, drilling fluid can pass through the ID of the muleshoe tube 210, through the holes 179 in the stop sub 146, and into the nozzles 41 of the casing bit 40. A portion of the drilling fluid is directed through the angled port 207 to provide "positive pressure" to assist in keeping formation cuttings from entering the assembly.

Figure 29:
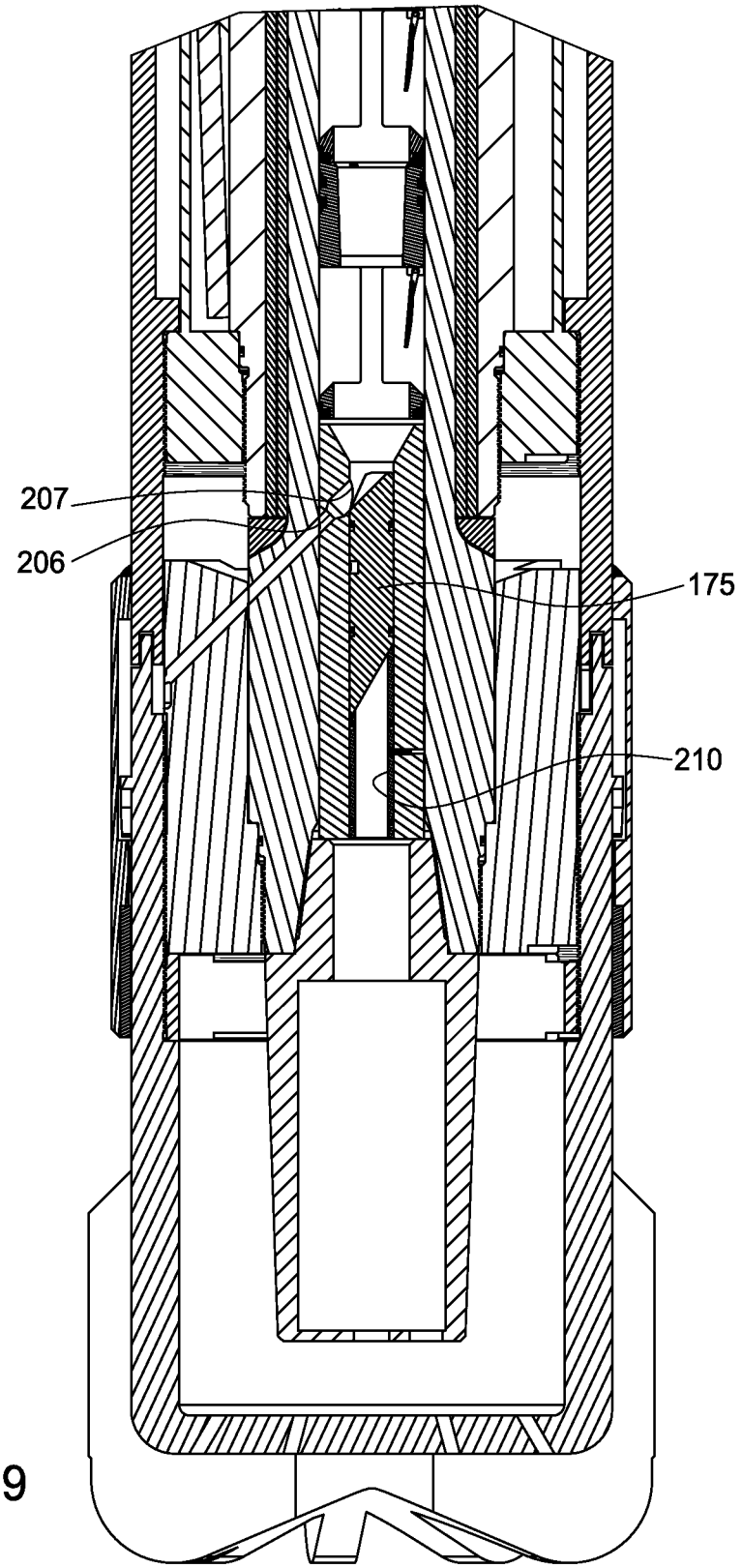
FIGS. 29-31 are sequential views of the lock-out mechanism for the casing bit of FIG. 28 in operation.

After drilling to TD, the bit drive assembly is prepared for cementing mode by dropping a large ball into the top of the motor 50 and shifting the cementing tube 170, as was described previously in FIGS. 17-22. The diverter piston 175 is released from its initial position at the top of the drilling motor 50. The diverter piston 175 travels downward, through the hollow bore motor 50, and lands against the muleshoe tube 210, as shown in FIG. 29. The geometry of the muleshoe angle will properly align the ramp on the upper end of the piston 175 with the angled ball seat 206 and angled port 207. The ramp will help guide the small locking balls into the angled port 207.

Figure 30:
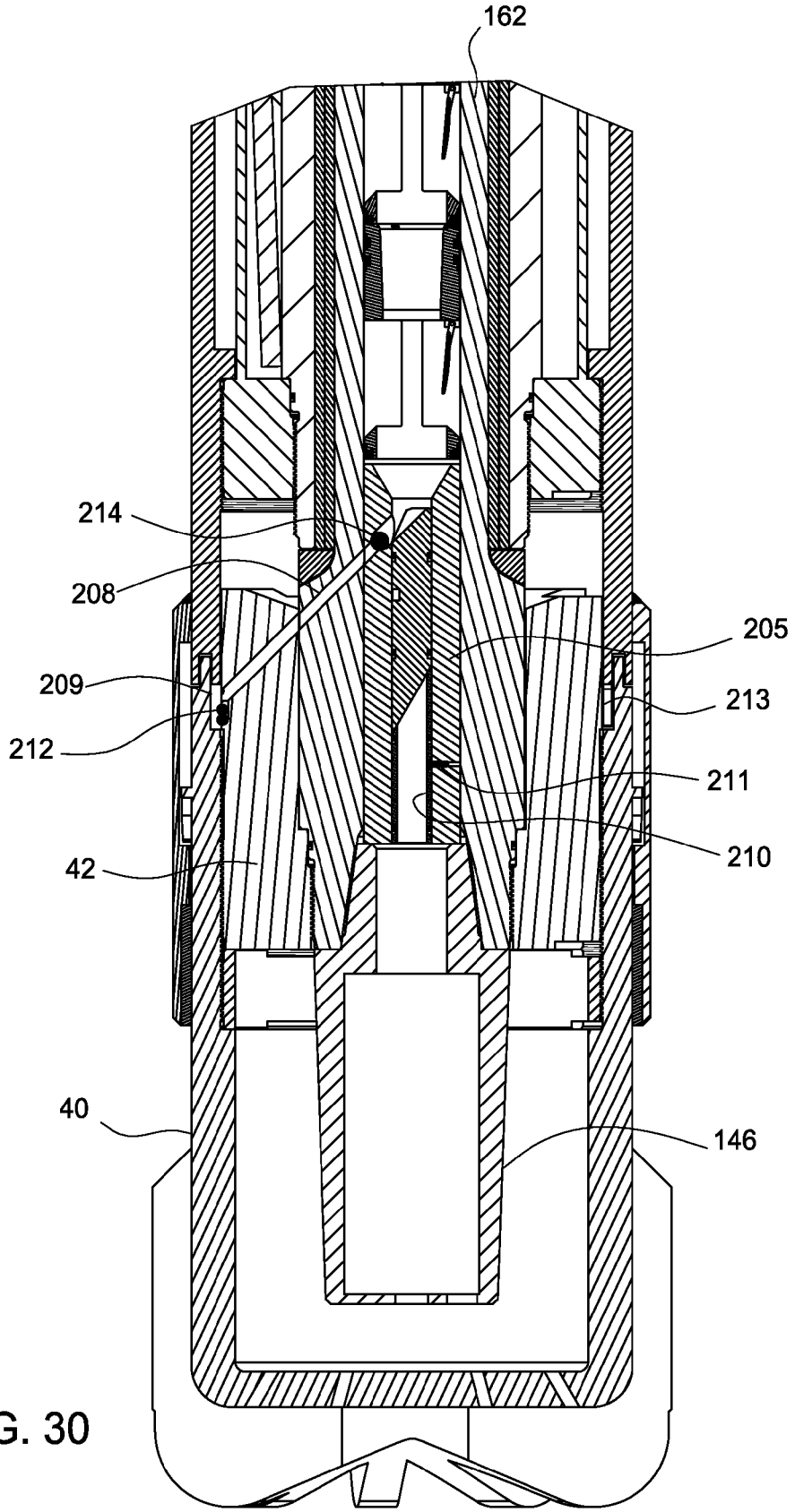

To rotationally lock the motor 50, one or more small balls 212 are dropped from surface, as shown in FIG. 30. The balls 212 are sufficiently sized to pass through the angled port 207. The balls 212 travel through the drillstring 5 and into the hollow bore motor 50. When the balls 212 contact the diverter piston 175 in the bottom of the motor 50, they are directed through the angled port in the guide sleeve 205, then through the complementary port in the output shaft 162 and lower aluminum coupling 42. The small balls 212 are seated in a recess 209 between the OD of the aluminum coupling 42 and the ID of the casing bit 40. The recess 209 is machined into the end of the casing sub 25, but is not a full 360° recess. Rather, the machined recess is an arc of less than 360°. This results in a shoulder 213 on the lower end of the casing sub bit 40. This shoulder 213 remains in the circular path.

After the small balls 212 have been seated, a larger ball 214 is dropped from surface, as shown in FIG. 30. The large ball 214 is sized to land in a seat 206 in the guide sleeve 205 to block the fluid flow path through the angled port 207. Pressure can then be increased to shear out the screw 211 on the muleshoe tube 210.

Figure 31:
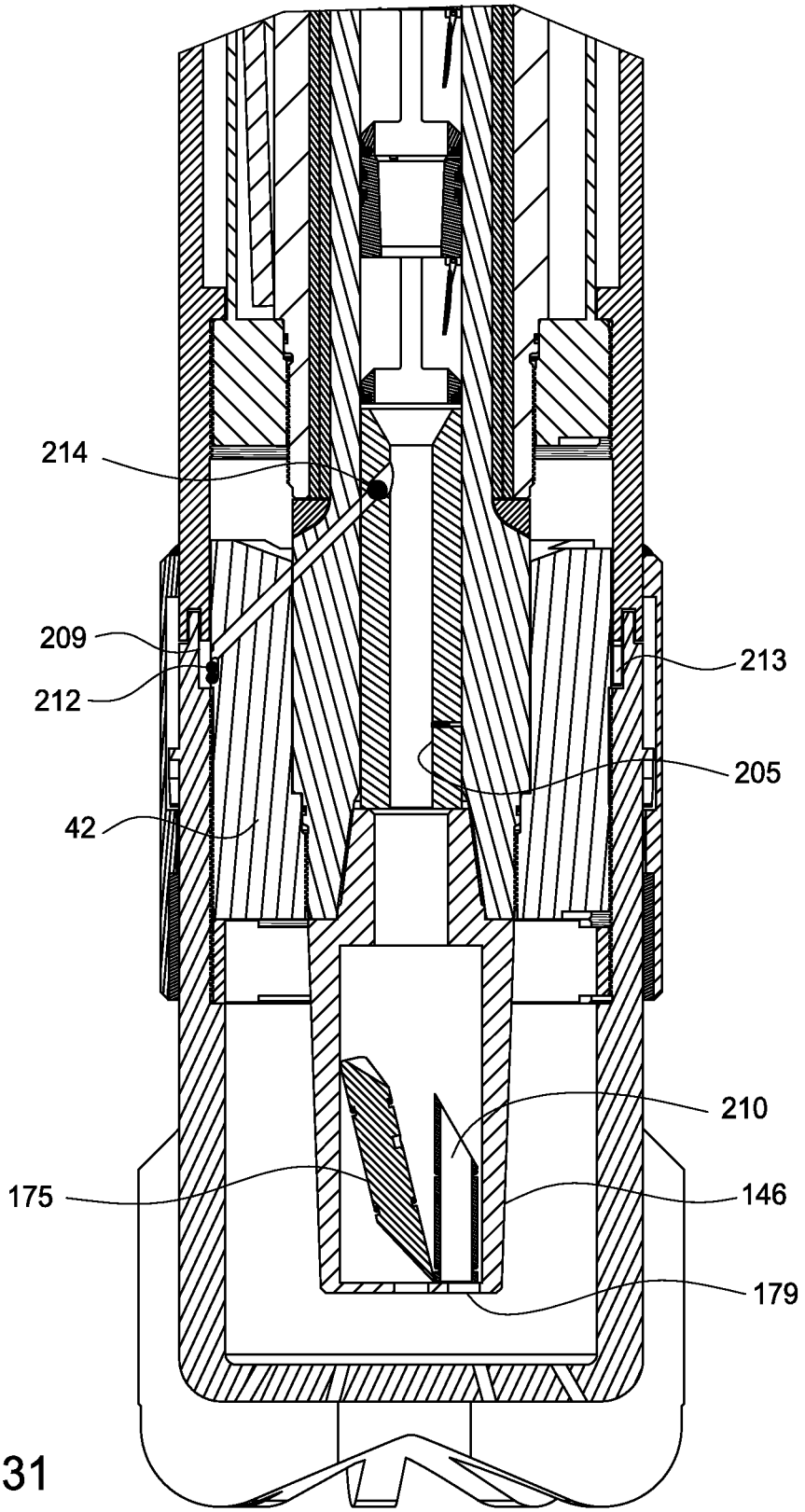

After the muleshoe screw has been sheared, the muleshoe tube 210 and diverter piston 175 are forced through the guide sleeve 205, and out of the motor 50. The stop sub 146 below the motor 50 traps the diverter piston 175 and muleshoe tube 210 as they exit the motor 50, as shown in FIG. 31. The guide sleeve 205 remains in the motor 50. Holes in the stop sub 146 allow fluid and cement to pass through while keeping the diverter piston 175 and muleshoe tube 210 trapped. An open circulation path is now available for cementing.

Because the balls 212 are trapped in the lower coupling 42, they will rotate together with the lower coupling 42. With sufficient rotation, for example, less than 360°, the balls 212 will come in contact with the shoulder 213 in the recess arc 209 of the casing bit 40. At this point, the casing bit 40 is effectively locked and can no longer rotate. Locking the casing bit 40 will aid the subsequent drill-out process in the event of a poor quality cement job at the shoe.

Figure 32:
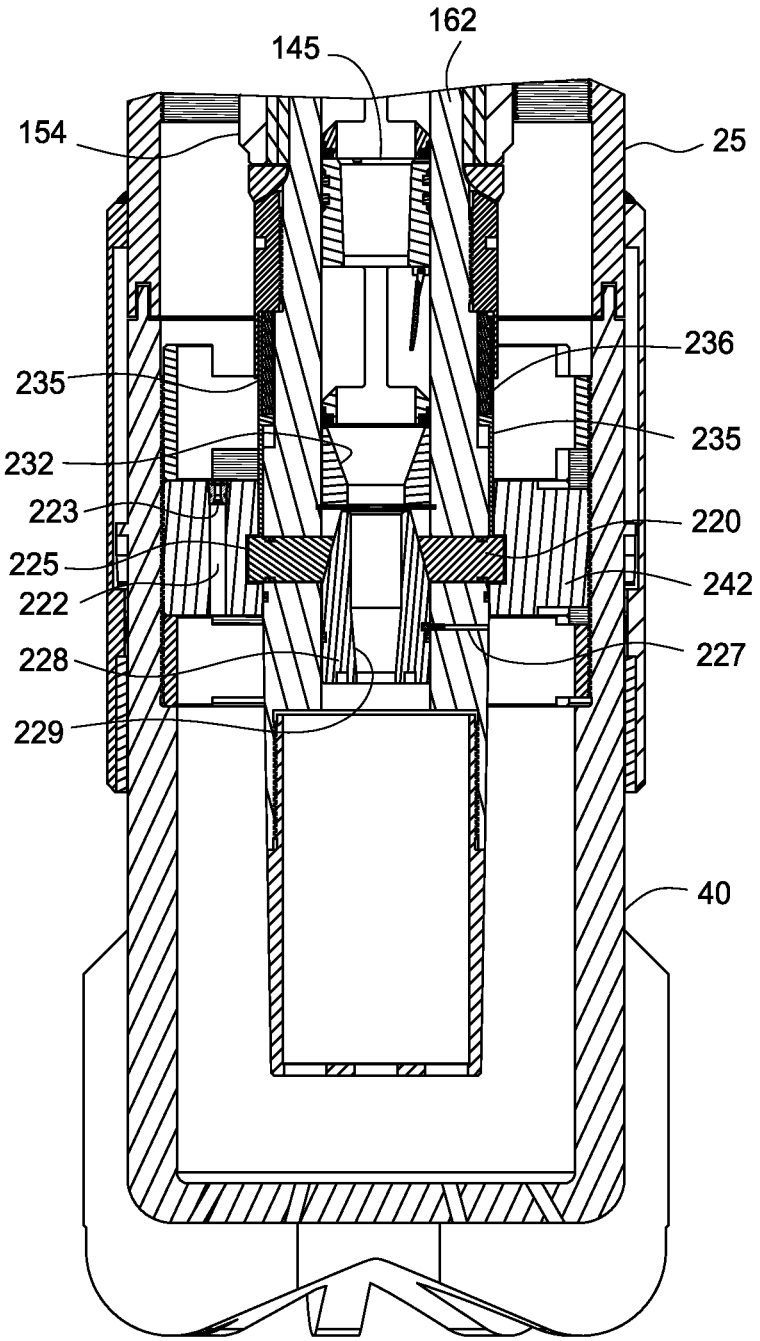
FIG. 32 illustrates another embodiment of a bit drive assembly.
Figure 33:
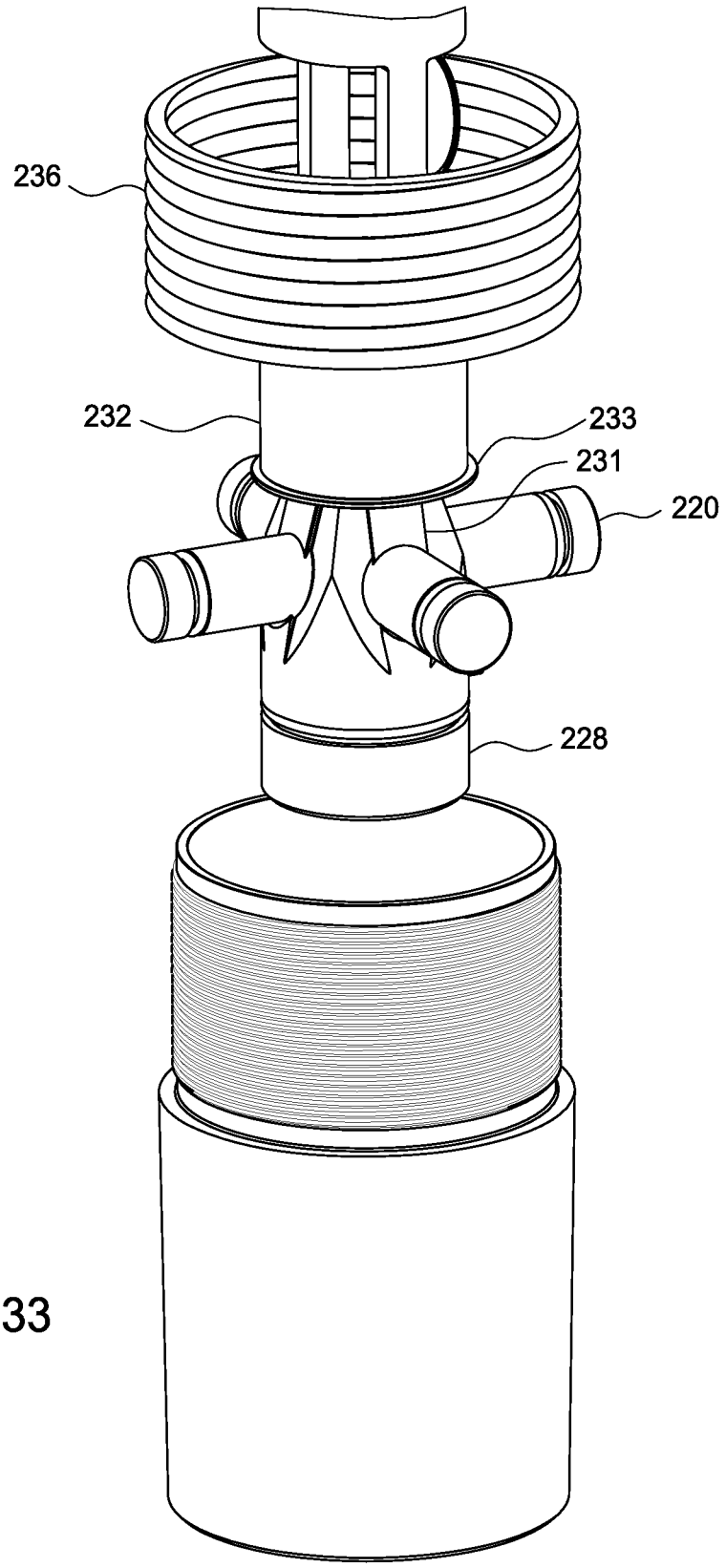
FIGS. 33 to 36 are sequential views of the releasable coupling of FIG. 32 in operation.
Figure 34:
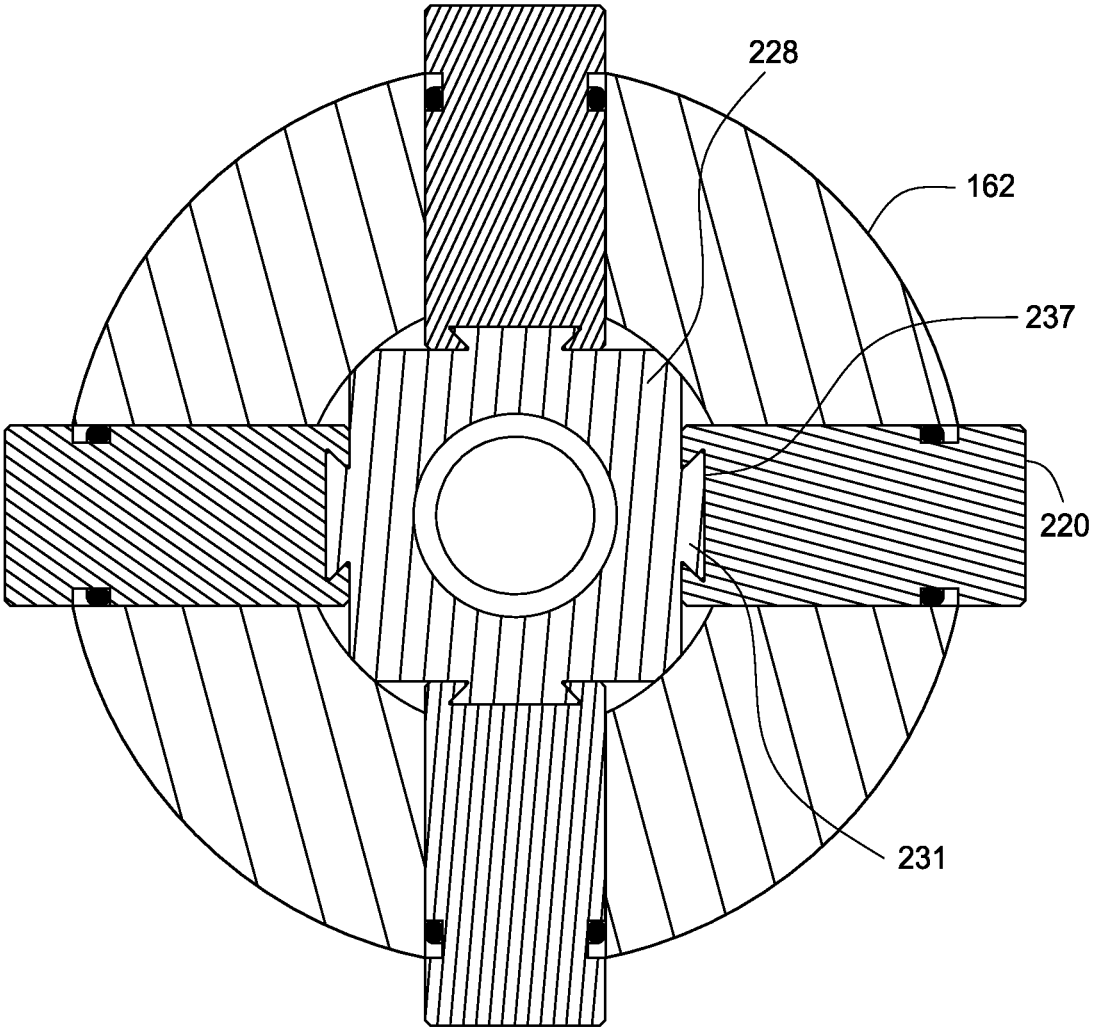

FIG. 32 illustrates another embodiment of a bit drive assembly. This embodiment contains many similarities to the embodiment shown in FIG. 11. For example, referring to FIG. 32, the features for cementing through the drilling motor 50 and locking the casing bit 40 during drill-out are similar to those shown in FIG. 11. For sake of clarity, only the differences will be discussed below. It is contemplated that one or more of differences may be used with the embodiment shown in FIG. 11 or any other suitable embodiment described herein. FIGS. 32 to 34 illustrate another embodiment of a mechanism for releaseably coupling the motor output shaft 162 to the casing bit 40 and releaseably coupling the motor housing 154 to the non-rotating casing 20. In this embodiment, the couplings use retractable dogs 220, as opposed to shearable threads, to transmit axial and torsional loads. One advantage of utilizing retractable dogs 220 is that relatively high forces can be transmitted, without requiring excessive overpull forces to release the motor 50 from the couplings. In another embodiment, the releasable coupling between the motor housing 154 and the casing 20 has been moved to a position on top of the drilling motor 50.

Figure 36:
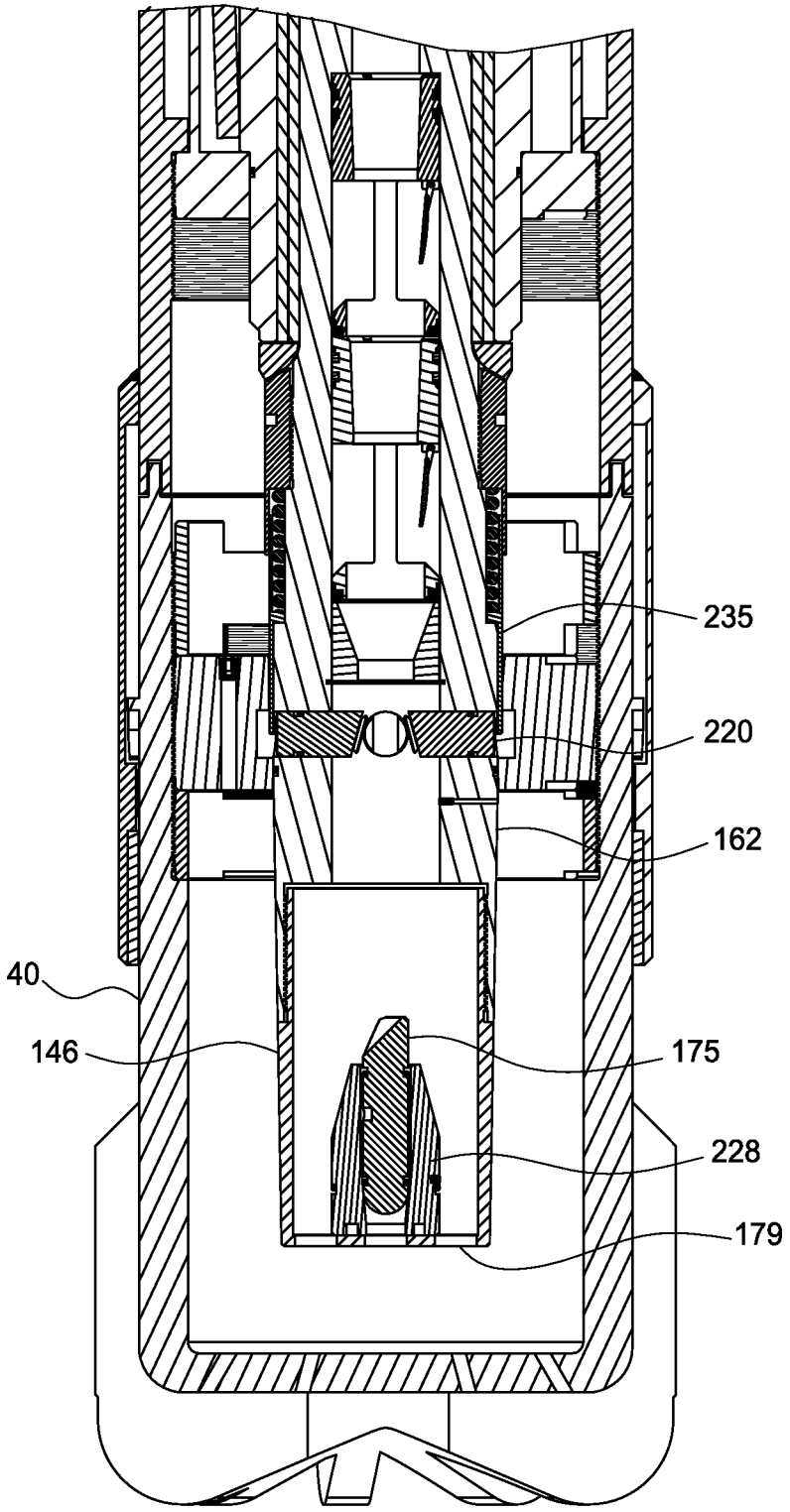

FIGS. 32 and 36 show a cross-section of the lower end of the assembly. The positive pressure port 222 has been re-located to a position in the drillable aluminum coupling 242, rather than through the motor output shaft 162 as shown in prior Figures. This new position allows for placement of a nozzle 223 in line with positive pressure port 222. The nozzle 223 can be any suitable size to achieve the desired proportion of fluid flow in relation to the flow exiting the nozzles in the casing bit 40.

Retractable dogs 220 are used to transmit axial and torque loads from the motor output shaft 162 to the lower aluminum coupling 242. In drilling mode, the dogs 220 extend through the output shaft 162 and into mating recesses 225 in the lower aluminum coupling 242. This releasable connection is used to drive the casing bit 40.

The dogs 220 are supported internally by the inner mandrel 228, which is installed in the bore of the motor output shaft 162. In drilling mode, the mandrel 228 is held in position by a shearable member such as shear screw(s) 227. The bore of the mandrel includes a ball or piston seat 229 configured to receive the diverter piston 175. As shown, four dogs 200 are used and equally spaced apart. However, any suitable number of dogs may be used.

The outer surface of the mandrel 228 contains a dovetail ramp profile 231, as shown in FIGS. 33 and 34. The inner ends of the dogs 220 include a mating dovetail ramp profile 237. When mated together, the mandrel 228 effectively grips the dogs 220. As the mandrel 228 shifts downward, the dogs 220 are positively retracted along the dovetail profile 231, 237, which puts the dogs 220 in the disengaged position.

Positioned above the mandrel 228 is a guide funnel 232, which is held in position by a retainer clip 233. The guide funnel 232 helps direct the diverter piston 175 into the mandrel's ball seat 229 as the diverter piston 175 passes through the floats 145. The guide funnel 232 and retainer clip 233 also keep the floats 145 from falling out.

A spring-loaded locking sleeve 235 is held in the upward position with the spring 236 compressed, when the dogs 220 are extended, as shown in FIG. 32. Downward travel of the locking sleeve 235 is prohibited by the extended dogs 220.

Figure 35:
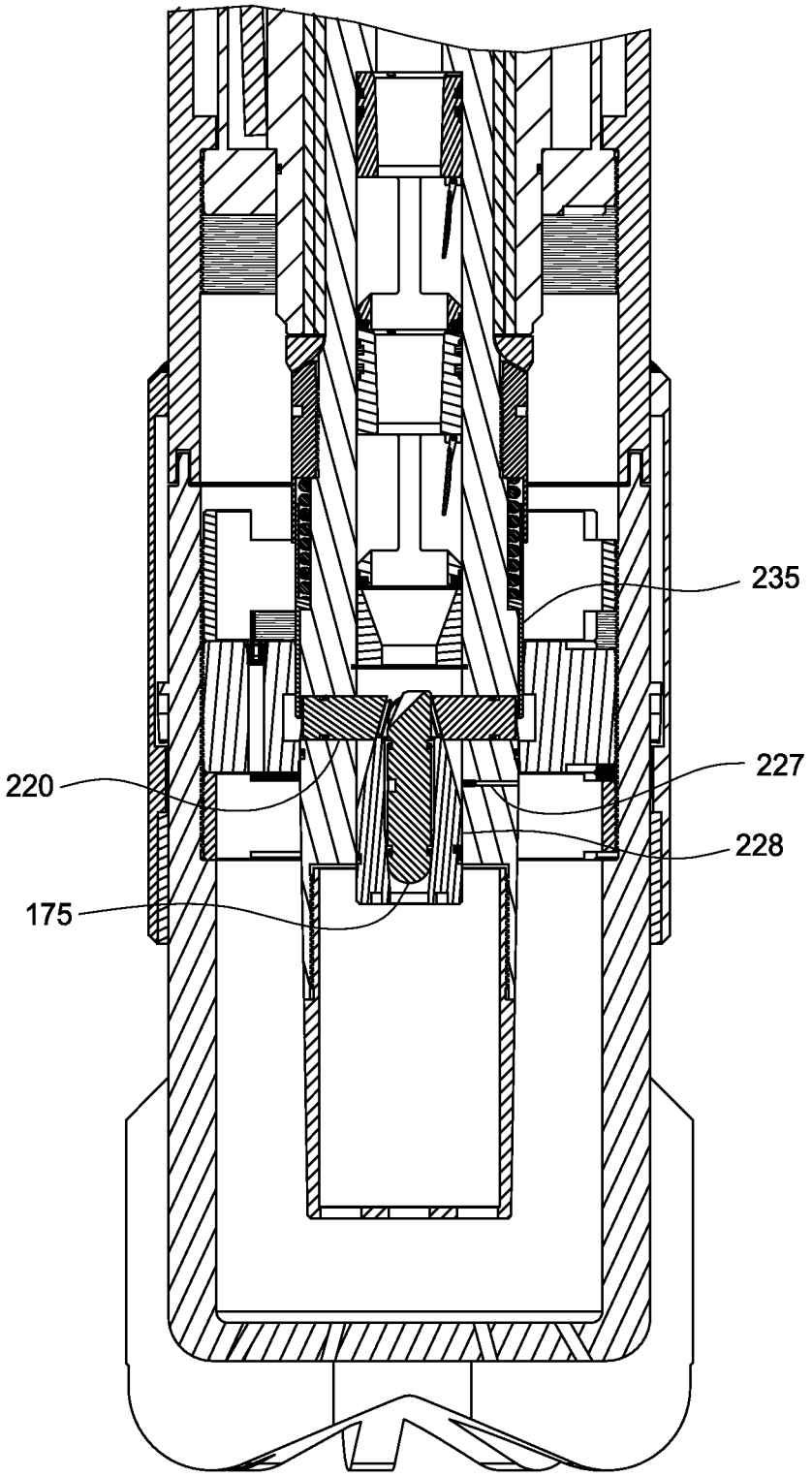

After drilling to target depth, the bit drive assembly is prepared for cementing mode by dropping a large ball into the top of the motor 50 and shifting the cementing tube 170, as was described previously in FIG. 11. The diverter piston 175 is released from its initial position at the top of the drilling motor 50. The diverter piston 175 travels downward, through the hollow bore motor 50, and lands the ball seat 229 of the mandrel 228, as shown in FIG. 35. Increasing pressure shears the mandrel shear screw 227, which releases the mandrel 228 to travel downward. As the mandrel 228 moves down, the dovetail profile 231, 237 positively retracts the dogs 220.

Once the dogs 220 have retracted, the spring-loaded locking sleeve 235 shifts downward, as shown in FIG. 35. The locking sleeve 235 keeps the dogs 220 from re-engaging during the cementing process. Pressure from pumping the cement cannot push the dogs 220 outward, because they are blocked by the locking sleeve 235.

The mandrel 228 and diverter piston 175 are forced downward and out of the motor 50. The stop sub 146 below the motor 50 traps the diverter piston 175 and mandrel 228 as they exit the motor 50. The dogs 220 remain in the motor 50 and in the retracted position. Holes 179 in the stop sub 146 allow fluid and cement to pass through while keeping the diverter piston 175 and mandrel 228 trapped. An open circulation path is now available for cementing.

Figure 37:
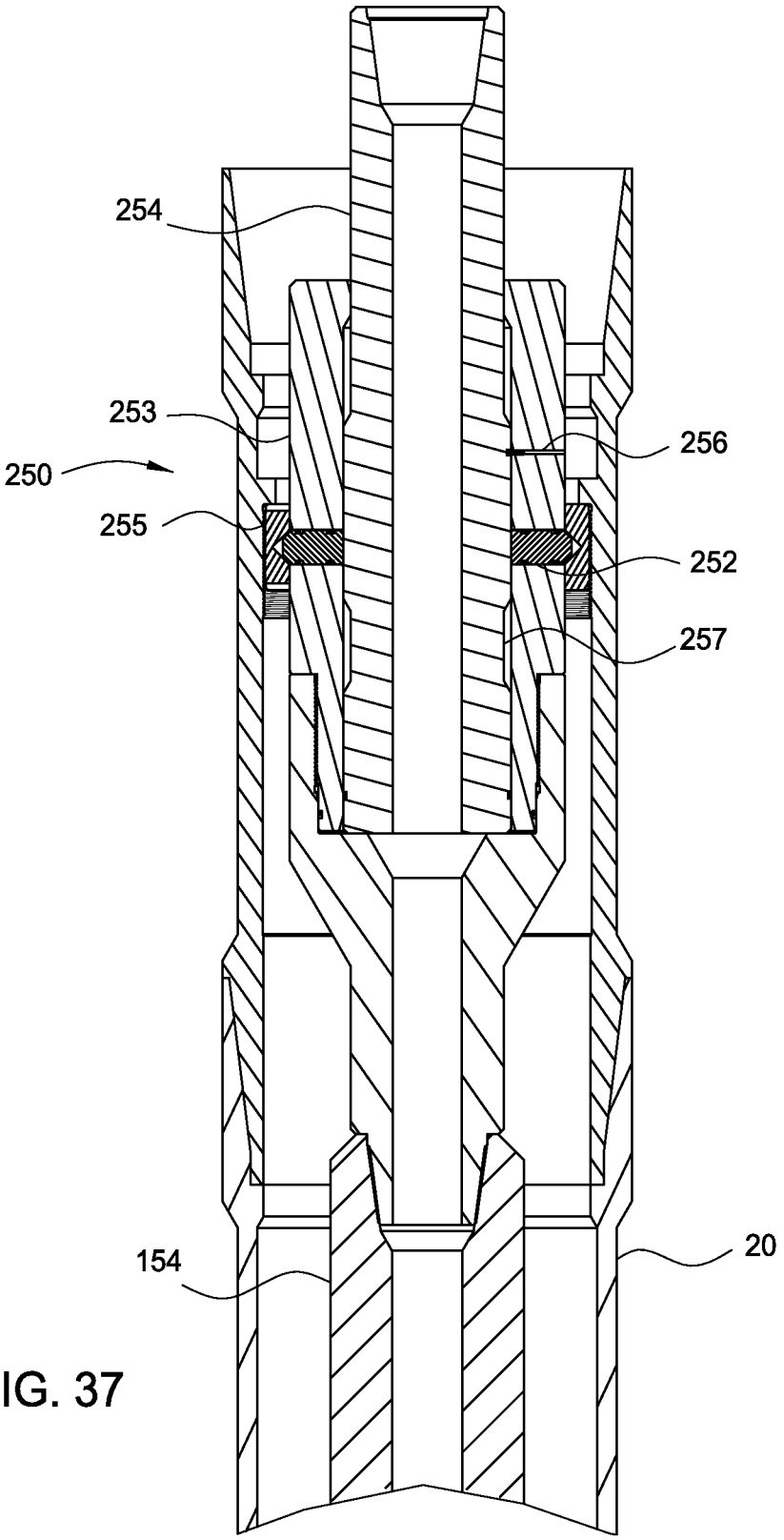
FIGS. 37-38 show an embodiment of a releasable coupling for coupling the motor to the casing.
Figure 47:
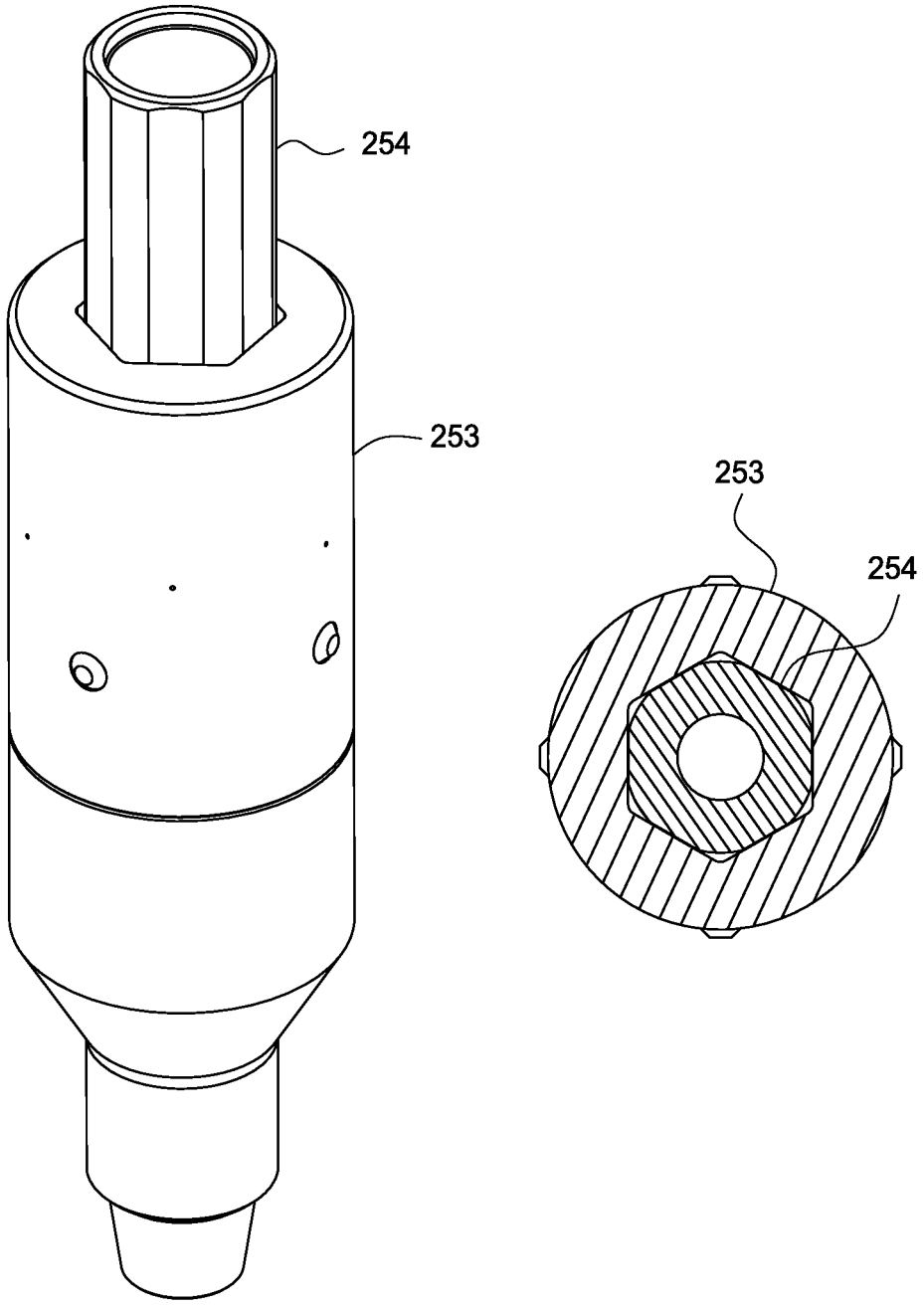
FIG. 47 illustrates an embodiment of a mandrel for use with the releasable coupling for coupling the motor to the casing.

The releasable coupling 250 between the motor housing 154 and casing 20 has been moved to a location on top of the drilling motor 50, shown in FIG. 37. The releasable coupling 250 includes a mandrel 254 attached to the inner string 22 and a coupling housing 253 releasably attached to the mandrel 254 using a shearable member 256 such as a shearable screw. Upper dogs 252 extend from the coupling housing 253 and engage the coupling receiver 255 that is attached to the casing 20. The dogs 252 on the upper coupling 250 are held in the engaged position by the inner mandrel 254. When the mandrel 254 is in the down position, the upper locking dogs 252 cannot retract. The mandrel 254 is held in the down position by the shearable member 256. The coupling housing 253 optionally includes a tapered hole for receiving the dogs 252. The coupling 252 may be made from a drillable material such as aluminum. In one embodiment, the mandrel 254 may include a polygonal configuration to facilitate transfer of torque, as shown in FIG. 47. For example, the mandrel 254 may have a hexagonal outer diameter and the housing 253 may have a complementary shape to receive the mandrel. Other suitable configurations include, but not limited to, triangle, rectangle, pentagon, and octagon.

After disengaging the lower dogs 220, cementing is performed through the hollow bore of the motor 50. The dogs 252 on the upper coupling 250 are not retracted prior to cementing. The upper dogs 252 remain engaged to the coupling receiver 255 of the casing 20 throughout the cementing process, in order to resist u-tubing forces as the cement is pumped. The engaged upper dogs 252 prevent the motor 50 from being pushed or "pumped" upward during cementing, and as the cement hardens.

Figure 38:
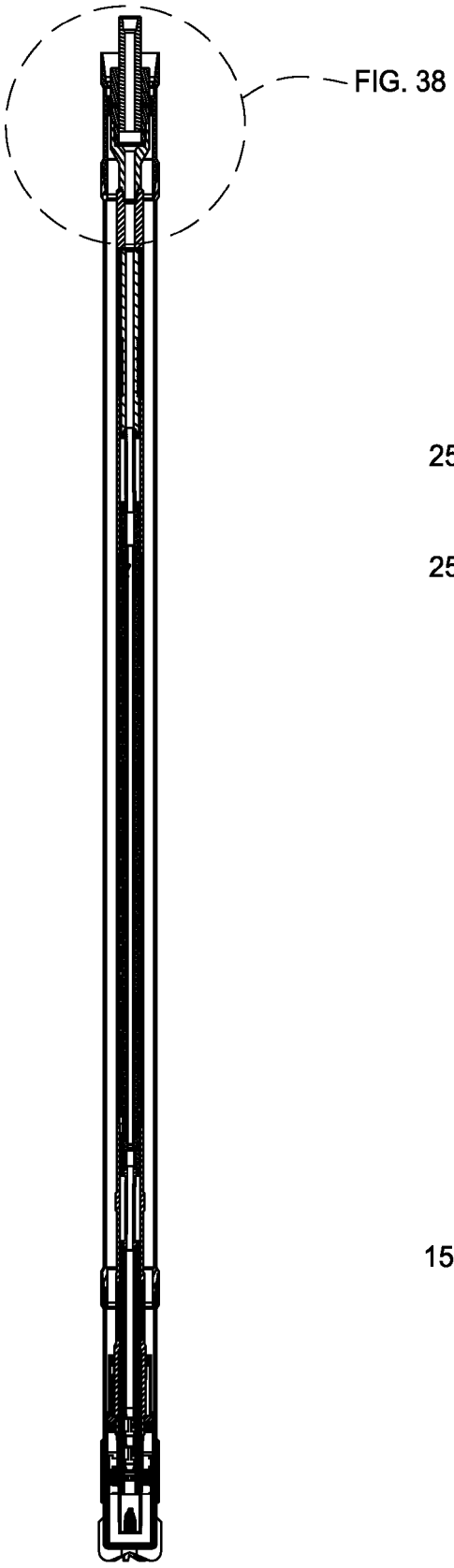
Figure 38:
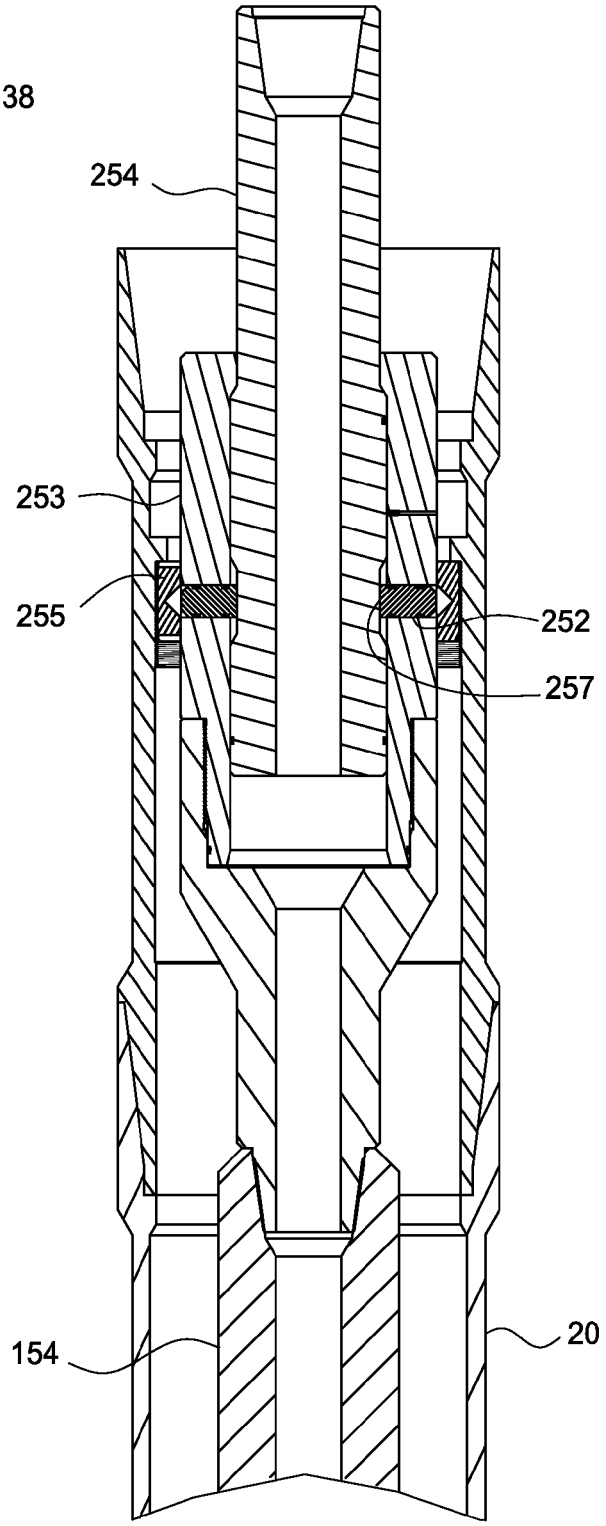

After the cement has hardened sufficiently to support the weight of the casing 20, the running tool 60, shown in FIG. 1 is released from the casing adapter in the casing 20. After releasing the running tool 60, the components including the drillstring 5, the running tool 60, and the inner string 22 can be pulled upward. With continued upward movement, the bumper subs (telescoping portions of the inner string) will become fully extended. The lower end of the inner string 22 is connected directly to the mandrel 254 of the upper coupling 250. Upward force is then applied to the mandrel 254, thereby shearing the screw(s) 256. The mandrel 254 is then pulled to the upward position, as shown in FIG. 38. Once the mandrel 254 is pulled to the upward position, the recess 257 on the outer diameter of the mandrel 254 is moved adjacent to the dogs 252. The dogs 252 are now free to move inward. Continued upward movement will force the tapered ends of the dogs 252 against the tapered holes in the coupling receiver 255. This will push the dogs 252 inward into the disengaged position. The drilling motor 50 is now uncoupled and can be retrieved with the inner string.

Figure 39:
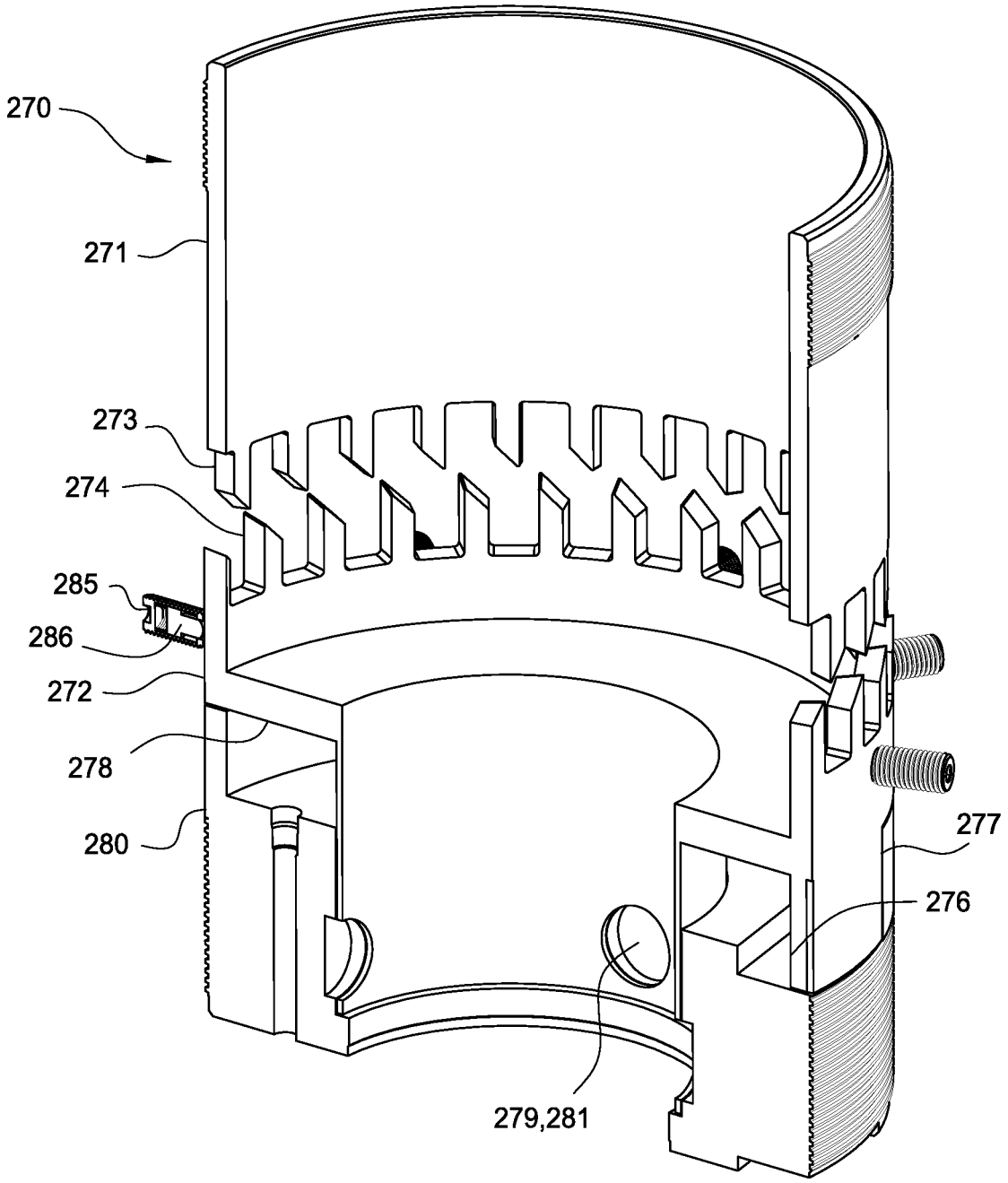
FIG. 39 illustrates another embodiment of a drill out locking mechanism.
Figure 40:
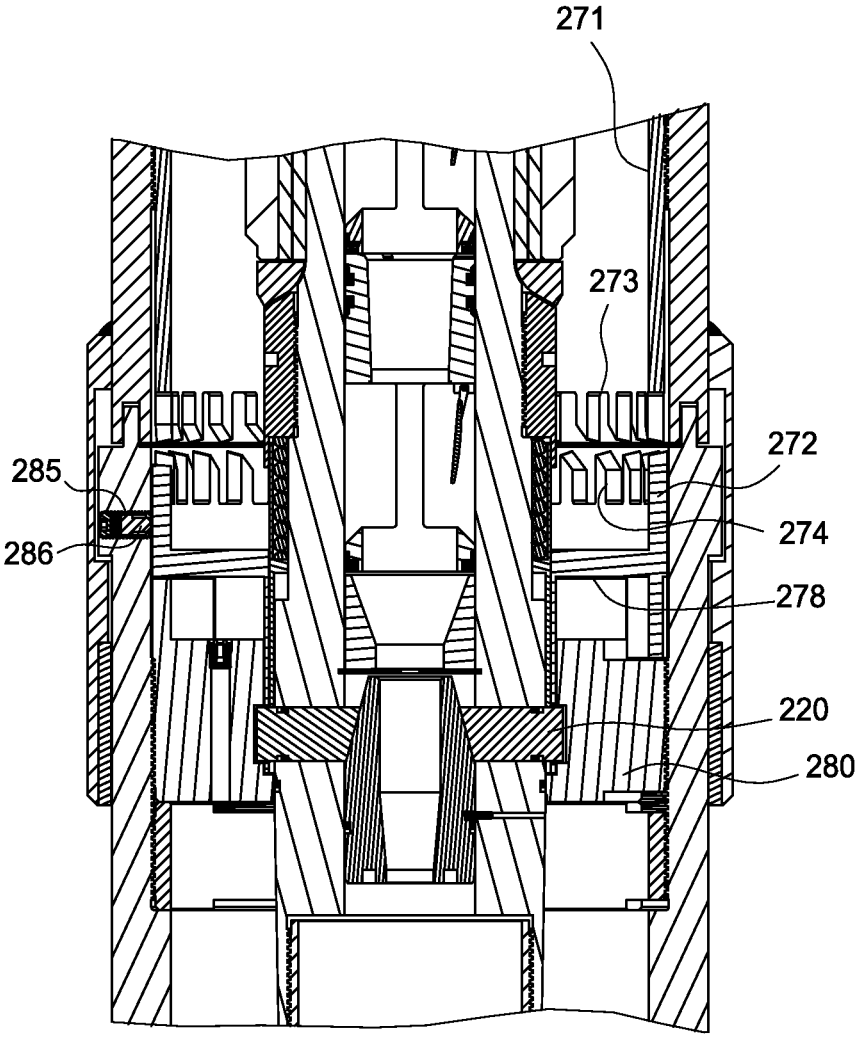
FIGS. 40-45 are sequential views of the locking mechanism of FIG. 39 in operation.
Figure 41:
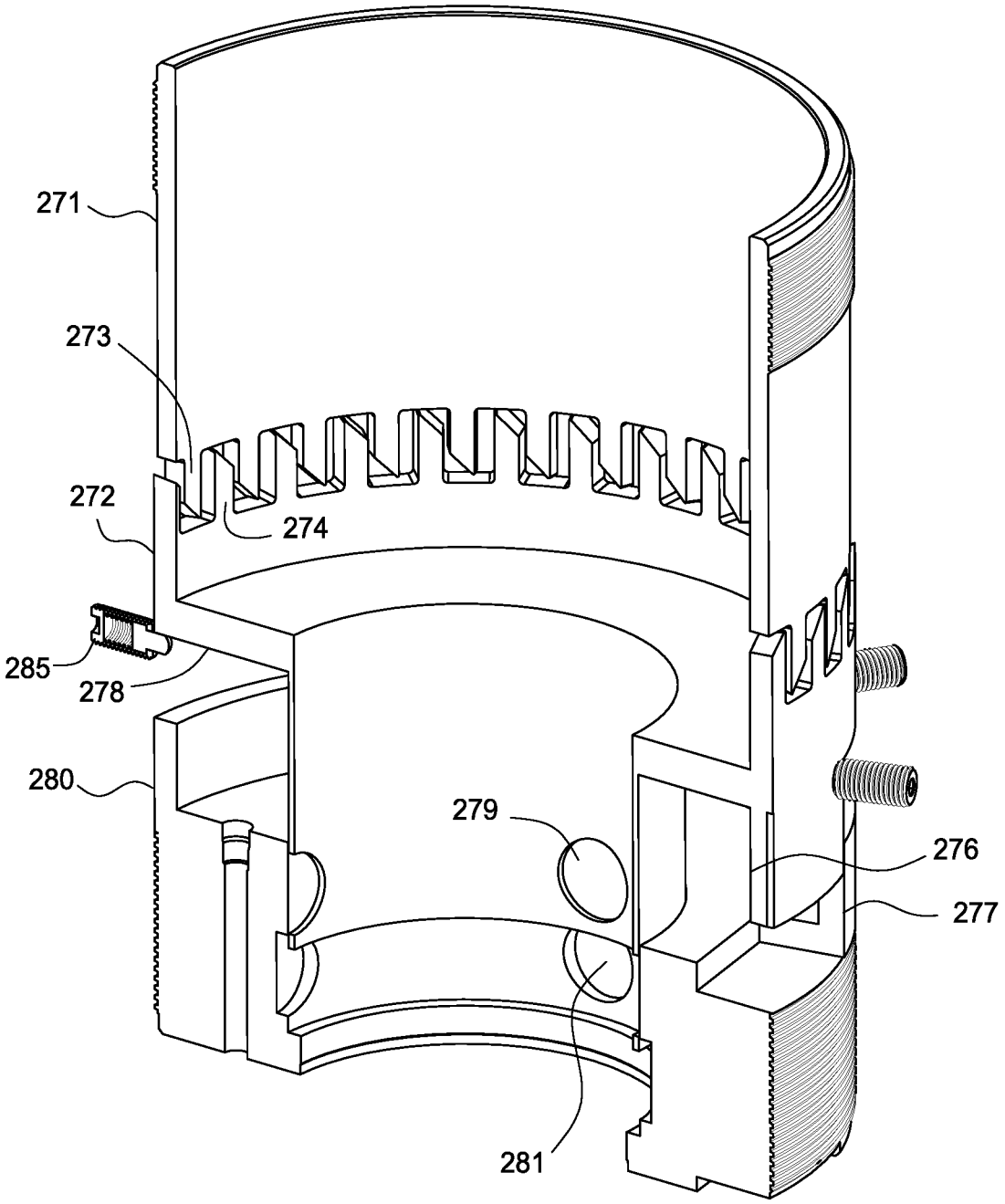

FIG. 39 illustrates another embodiment of a drill out locking mechanism. The casing bit drive assembly of FIGS. 39 and 40 contains many similarities to the embodiment shown in FIG. 32. For sake of clarity, only the differences will be discussed below. One difference is the drill-out locking mechanism for the casing bit 40.

After the motor 50 is retrieved, the casing bit 40 is no longer directly coupled to the casing sub 25. In ideal conditions, a good cement job at the casing shoe will prevent the casing bit 40 from spinning freely as it is drilled-out in subsequent operations. If the casing bit 40 is not rotationally constrained, the drill-out process may be problematic. In the event of a poor quality cement job, or "wet shoe", the casing bit 40 system includes a mechanical feature provides a contingency mechanism for rotationally locking the casing bit 40 to the casing sub 25. Locking these two components allows the casing bit 40 to be drilled-out more easily, since rotation of the casing bit 40 is prevented.

Referring to FIG. 39, in one embodiment, the locking mechanism 270 includes one set of teeth 273 machined into the end of a sleeve 271 which is threaded and securely fastened to the non-rotating casing sub 25. This upper locking sleeve 271 is rotationally and axially affixed to the casing sub 25. A mating set of teeth 274 is machined into a movable lower sleeve 272. The lower locking sleeve 272 has tabs 276 which mate with slots 277 in the lower aluminum base 280. These tabs 276 and slots 277 remain aligned as the lower sleeve 272 moves axially upward toward upper locking sleeve 271. The tabs 276 and slots 277 prevent relative rotation between the lower locking sleeve 272 and the drillable aluminum base 280.

The lower sleeve 272 includes a shoulder 278 connecting the upper, larger diameter portion of the sleeve 272 containing the teeth 274 and the lower, smaller diameter portion of the sleeve 272. The shoulder 278 is positioned above the aluminum base 280. The lower sleeve 272 is held in the unengaged, down position by the lower dogs 220 during drilling mode. The dogs 220 extend through holes 279 in the lower locking sleeve 272 and also into holes 281 in the aluminum base 280. In drilling mode, the dogs 220 are engaged with the aluminum base 280 to transmit axial and torsion loads from the motor output shaft 162 to the casing bit 40. The extended dogs 220 also prevent the lower locking sleeve 272 from moving upward. While the dogs 220 are extended or engaged, the lower sleeve 272 cannot move upward.

Spring loaded plungers 285 are positioned in the wall of the casing bit 40. The plungers 285 are spring biased inward. In drilling mode, the spring 285 is compressed as the plunger tip 286 is compressed against the OD of the lower locking sleeve 272. The plungers 285 do not prevent upward movement of the lower locking sleeve 272.

Figure 42:
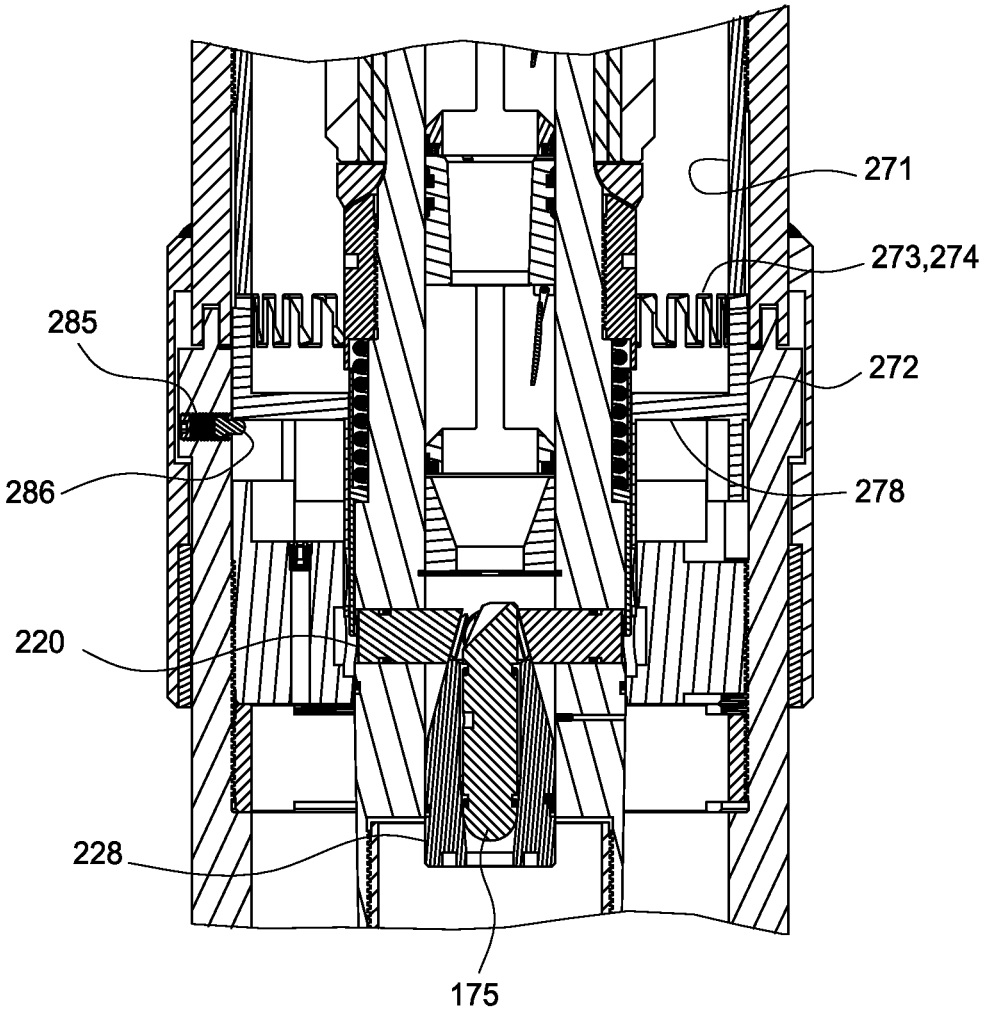

After drilling to TD, the bit drive assembly is prepared for cementing mode by dropping a large ball into the top of the motor 50 and shifting the cementing tube 170, as was described previously in FIGS. 18-22. The diverter piston 175 is released from its initial position at the top of the drilling motor 50. The diverter piston 175 travels downward, through the hollow bore motor 50, and lands the ball seat of the mandrel 228, shown in FIG. 42. The pressure is increased to shear the mandrel shear screw 227, and to force the mandrel 228 to move downward, thereby positively retracting the dogs 220.

Figure 43:
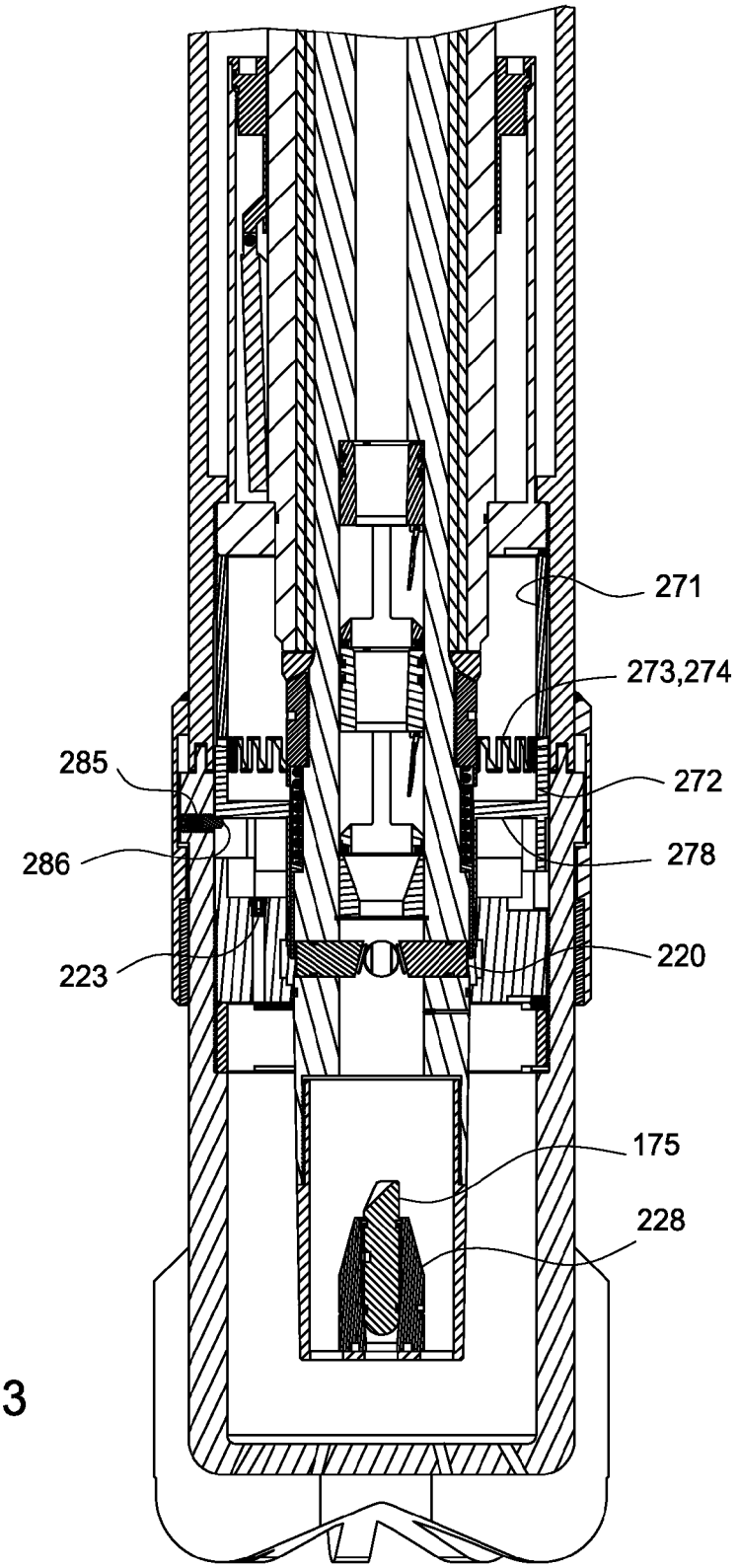

In cementing mode as shown in FIG. 43, when the lower dogs 220 are retracted, the lower sleeve 272 is no longer constrained by the dogs 220. Pressure from the positive pressure nozzle 223 will urge the lower sleeve 272 to move upward. As the teeth 274 on the lower sleeve 272 move toward to teeth 273 on the upper sleeve 271, the casing bit 40 becomes rotationally locked for the subsequent drill-out process. This locking mechanism 270 is activated prior to pumping cement.

As the shoulder 278 of the lower locking sleeve 272 moves up past the spring loaded plungers 285, the inwardly biased plunger tips 286 extend inward and under the shoulder 278. The plunger 285 prevents the lower locking sleeve 272 from moving back down, even if downward force is applied during the subsequent drill-out process.

Figure 44:
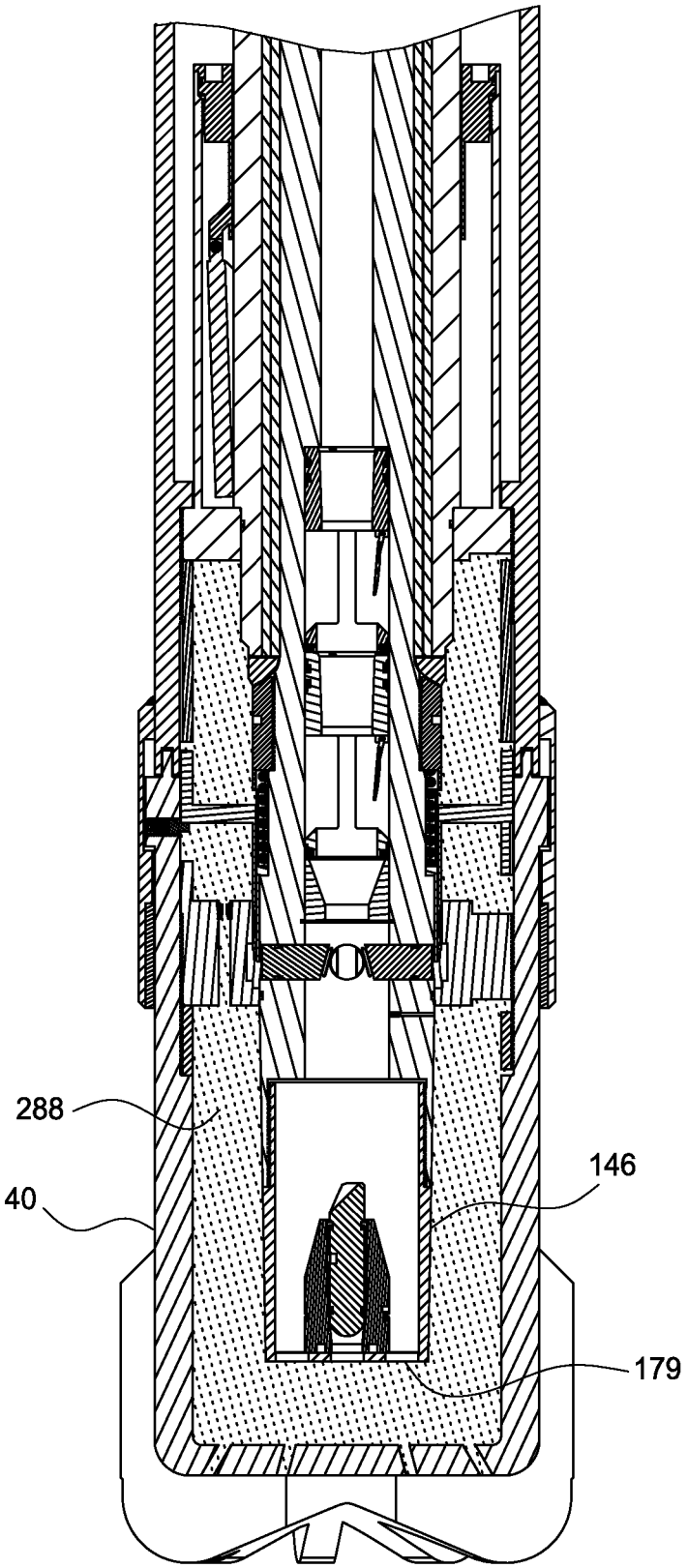

In the operation sequence shown in FIG. 44, the cement is then pumped through the drillstring and inner string, into the hollow bore motor 50, through the holes 179 in the stop sub 146, out of the nozzles in the casing bit 40, and into the annulus between the casing 20 and the borehole. Some cement 288 will enter the cavities adjacent to the lower end of the drilling motor 50 as seen in FIG. 44. After the cement has hardened sufficiently to support the weight of the casing 20, the running tool 60 shown in FIG. 1 is released from the casing adapter of the casing 20. The upper coupling 250 between the motor 50 and the casing 20 is released by pulling up on the inner string 22 as described in FIGS. 37-38. The running tool, inner string, and drilling motor 50 are then pulled to surface.

Figure 45:
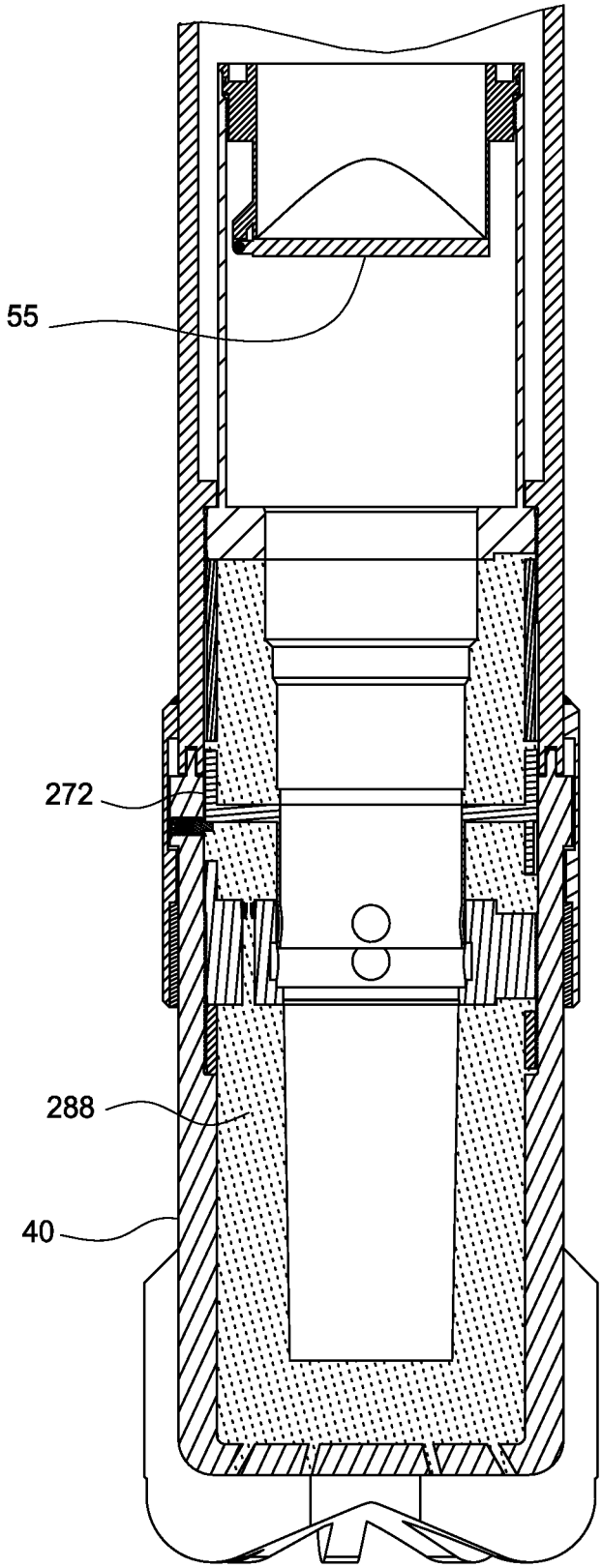

As the drilling motor 50 is retrieved up through the secondary flapper float valve 55, the flapper closes, as shown in FIG. 45. Once the motor 50 is no longer holding the float 55 in the open position, the spring loaded flapper is free to pivot to the closed position. This secondary flapper float valve 55 remains in place after the motor 50 is retrieved, and acts as a secondary pressure barrier. This barrier feature may act as a safety feature, especially in the event of a poor quality cement job at the shoe.

After retrieving the motor 50, a second bottom hole assembly (BHA) is then run in the hole to drill out the cement shoe track and the drillable casing bit 40. This drilling BHA may continue drilling ahead into new formation. The casing bit drive and cementing components remaining in the drill-out path may be manufactured from a drillable material (e.g., aluminum, composite, polymer, copper, brass, bronze, zinc, tin, or alloys thereof).

The locking teeth 273, 274 and tabs 276, 277 on the locking sleeve 271, 272 are positioned such that they remain outside the drill-out path, as shown in FIG. 45. In this manner, the casing bit 40 is prevented from rotating throughout the drill-out process.

Figure 46:
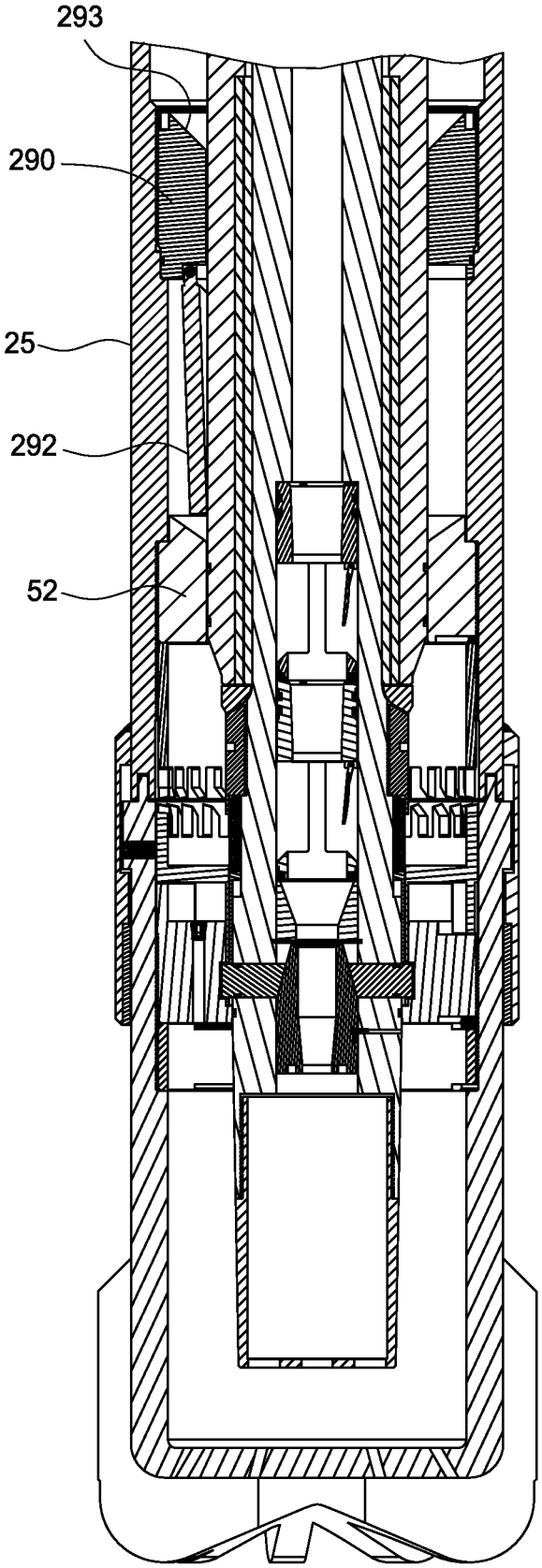
FIG. 46 illustrates another embodiment of a float valve.

In another embodiment, a secondary flapper valve 292 is positioned in the casing sub 25. In previous embodiments, for example FIG. 11, the extension sleeve 76 is integral to the upper coupling 52, which couples the motor housing 154 to the casing 20. In FIG. 46, the extension sleeve 76 has been removed. The float housing 290 is affixed directly to the casing sub 25, such as by a threaded connection.

The secondary flapper valve 292 is held in the open position while the motor 50 is installed. The motor 50 is positioned such that is passes through the bore of the flapper valve 292, thus preventing the spring loaded flapper from pivoting into the closed position. This secondary flapper valve 292 remains in the open position during the drilling and cementing processes.

After drilling and cementing operations are completed, the motor 50 is retrieved up through the secondary flapper valve 292. Once the motor 50 is no longer effectively holding the flapper valve 292 in the open position, the spring loaded flapper is free to pivot into the closed position. This secondary flapper valve 292 remains in place after the motor 50 is retrieved, and acts as a secondary pressure barrier.

As shown in FIG. 46, the upper ends of the upper coupling 52 and the float housing 290 include a tapered or beveled profile 293. This profile 293 may be used to guide the subsequent drill-out bit, and help keep it centralized during the drill-out process.

During the drill-out process, a subsequent bit is used to drill through the secondary flapper valve 292. In the float geometry shown in FIG. 11, the lower portion of the float housing 290 and flapper may break free and fall downward. This piece of unrestrained material may be problematic to drill through. The geometry of the float housing 290 of FIG. 46 better restrains the flapper during the drill-out process. Because a portion of the float housing 290 remains outside of the drill-out path, the flapper is constrained until the drill-out bit drills into the hinge pin. This allows a larger percentage of the flapper to be drilled, before breaking free.

The drill-out bit then continues drilling out the shoe track, the casing bit 40, and into new formation.

In one embodiment, a method of forming a wellbore in a formation includes providing a first casing with a motor for rotating a drilling member relative to the first casing; coupling the first casing to a second casing; lowering the first casing and the second casing into the formation; releasing the first casing from the second casing; rotating the drilling member to extend the wellbore; supplying cement around the motor and into the wellbore; detaching the motor from the drilling member; and retrieving the motor.

In one or more of the embodiments described herein, the motor is coupled to a non-rotating portion of the first casing and to a rotating portion of the drilling member.

In one or more of the embodiments described herein, the motor is releasably coupled to the first casing using a shearable threaded connection.

In one or more of the embodiments described herein, the motor includes a rotatable member and a stationary member, and further comprising preventing the rotatable member from rotation.

In one or more of the embodiments described herein, the rotatable member is prevented from rotation by landing a ball in a recess between the rotatable member and the stationary member.

In one or more of the embodiments described herein, the cement is diverted to a cementing tube.

In one or more of the embodiments described herein, the cement is diverted through a bore in the motor.

In one or more of the embodiments described herein, the bore for diverting cement is located in a rotatable member of the motor.

In one or more of the embodiments described herein, the drilling member is locked from rotating relative to the first casing.

In one or more of the embodiments described herein, locking the drilling member from rotation includes engaging a first set of teeth of the first casing to a second set of teeth of the drilling member. In one or more of the embodiments described herein, the first set of teeth is coupled to the first casing using a locking segment.

In one or more of the embodiments described herein, locking the drilling member includes moving a lower sleeve coupled to the motor toward an upper sleeve coupled to the first casing; and engaging a first set of teeth of the upper sleeve to a second set of teeth of the lower sleeve.

In one or more of the embodiments described herein, detaching the motor from the drilling member includes retracting a dog from engagement with the drilling member. In one or more of the embodiments described herein, the retracted dog is prevented from re-extending.

In one or more of the embodiments described herein, retracting the dog includes axially moving a mandrel coupled to the dog.

While the foregoing is directed to embodiments of the present invention, other and further embodiments of the invention may be devised without departing from the basic scope thereof, and the scope thereof is determined by the claims that follow.

The invention claimed is:

1. A casing drilling system, comprising:

a casing;

a drilling member coupled to the casing;

a motor releasably coupled to the casing and includes a power section configured to rotate the drilling member relative to the casing, wherein the motor includes a rotating portion and non-rotating housing, and the rotating portion includes an axial bore extending therethrough; and a cement diverter for diverting cement from the power section of the drilling motor, wherein the cement diverter includes a sleeve disposed in the bore and releasably coupled to the rotating portion and having a port for fluid communication with the power section; and a diverter piston releasably coupled to the sleeve and configured to direct drilling fluid through the port, and wherein, after release, the diverter piston is axially movable in the bore.

2. The system of claim 1, wherein the power section comprises an annular area between the rotating portion and a non-rotating portion.

3. The system of claim 2, further comprising a coupling for transferring load between the non-rotating housing and the casing.

4. The system of claim 2, further comprising a bearing for transmitting load from an output connected to the rotating portion to the non-rotating housing.

5. The system of claim 2, wherein the motor includes an arcuate recess formed in non-rotating housing, wherein a ball received at an end of the arcuate recess prevents relative rotation between the rotating portion and the non-rotating housing.

6. The system of claim 1, further comprising a locking mechanism to prevent relative rotation between the drilling member and the casing.

7. The system of claim 1, further comprising a releasable coupling assembly for coupling an output shaft of the motor to the drilling member.

8. The system of claim 1, further comprising a releasable coupling assembly for coupling the motor to the casing.

9. The system of claim 1, wherein the rotating portion includes an entry port in fluid communication with the port of the sleeve.

10. The system of claim 9, wherein the motor includes an arcuate recess formed in the non-rotating housing, wherein a ball received at an end of the arcuate recess prevents relative rotation between the rotating portion and the non-rotating housing.

11. The system of claim 9, further comprising a locking mechanism to prevent relative rotation between the drilling member and the casing.

12. The system of claim 9, further comprising a releasable coupling assembly for coupling an output shaft of the motor to the drilling member.

13. The system of claim 9, further comprising a releasable coupling assembly for coupling the motor to the casing.

14. The system of claim 9, wherein the entry port is configured to receive a ball for blocking fluid communication with the power section.

15. The system of claim 9, wherein the sleeve is configured to release at a lower force than the diverter piston.

16. The system of claim 1, wherein the sleeve is configured to release before the diverter piston.

17. The system of claim 1, wherein the diverter piston is configured to divert a ball into the port.

18. A method of forming a wellbore in a formation, comprising:

providing a first casing with a motor for rotating a drilling member relative to the first casing, wherein the motor includes a rotatable member and a stationary member, and the rotatable member includes an axial bore extending therethrough;

a sleeve releasably coupled to the axial bore and having a port for fluid communication with an annular area between the rotatable member and the stationary member; and a diverter piston releasably coupled to the sleeve and configured to direct drilling fluid through the port;

coupling the first casing to a second casing;

lowering the first casing and the second casing into the formation;

releasing the first casing from the second casing;

flowing drilling fluid through the port;

rotating the drilling member to extend the wellbore;

releasing the sleeve to block the port;

releasing the diverter piston to travel down the bore;

supplying cement through the bore of the motor and into the wellbore;

detaching the motor from the drilling member; and retrieving the motor.

19. The method of claim 18, wherein the motor is coupled to a non-rotating portion of the first casing and to a rotating portion of the drilling member.

20. The method of claim 18, further comprising preventing the rotatable member from rotation.

21. The method of claim 20, wherein preventing rotation of the rotatable member comprises landing a ball in a recess between the rotatable member and the stationary member.

22. The method of claim 18, further comprising directing a ball through the port, thereby blocking fluid flow to the annular area.

23. The method of claim 22, wherein the ball seats in an entry port of the rotatable member.

24. The method of claim 22, wherein releasing the sleeve from the axial bore occurs after the ball moves through the port.

25. A casing drilling system, comprising:

a casing;

a drilling member coupled to the casing;

a motor releasably coupled to the casing and includes a power section configured to rotate the drilling member relative to the casing, wherein the motor includes a rotating portion and non-rotating housing, and wherein the rotating portion includes:

an axial bore extending therethrough;

an entry port in fluid communication with the axial bore; and a seat disposed in the entry port for receiving a ball; and a cement diverter for diverting cement from the entry port and the power section of the drilling motor, wherein the cement diverter includes:

a sleeve disposed in the axial bore and releasably coupled to the rotating portion and having a port for fluid communication with the power section; and a diverter piston releasably coupled to the sleeve and configured to direct drilling fluid through the port, and wherein, after release, the diverter piston is axially movable in the bore.

* * * * *